US007199341B2

(12) United States Patent
Kaneko et al.

(10) Patent No.: US 7,199,341 B2
(45) Date of Patent: Apr. 3, 2007

(54) HIGH-FREQUENCY HEATING APPARATUS

(75) Inventors: Fuminori Kaneko, Osaka (JP); Hiroki Kitayama, Osaka (JP); Yoshikazu Yamamoto, Osaka (JP); Yuzi Andoh, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 1 day.

(21) Appl. No.: 10/519,127

(22) PCT Filed: Jul. 25, 2003

(86) PCT No.: PCT/JP03/09495

§ 371 (c)(1),
(2), (4) Date: Aug. 29, 2005

(87) PCT Pub. No.: WO2004/014107

PCT Pub. Date: Feb. 12, 2004

(65) Prior Publication Data

US 2006/0096979 A1 May 11, 2006

(30) Foreign Application Priority Data

Aug. 2, 2002 (JP) ..... 2002-225939
Aug. 2, 2002 (JP) ..... 2002-225946
Aug. 2, 2002 (JP) ..... 2002-226179

(51) Int. Cl.
*H05B 6/74* (2006.01)
*H05B 6/72* (2006.01)

(52) U.S. Cl. ..... 219/746; 219/749

(58) Field of Classification Search ..... 219/746, 219/745, 747, 748, 749
See application file for complete search history.

(56) References Cited

U.S. PATENT DOCUMENTS 4,156,829 A * 5/1979 Harada ..... 315/39.51
4,324,967 A * 4/1982 Ikeda et al. ..... 219/749
4,508,946 A * 4/1985 Yoshimura et al. ..... 219/749
6,076,957 A 6/2000 Gomes
6,166,363 A * 12/2000 Shon et al. ..... 219/703
6,759,639 B2 * 7/2004 Shon et al. ..... 219/761

FOREIGN PATENT DOCUMENTS

JP 53-90043 8/1978
JP 53-101753 9/1978
JP 58-220387 12/1983
JP 59-14294 10/1984
JP 5-54910 7/1993
JP 10-211098 8/1998
JP 11-008057 1/1999

* cited by examiner

*Primary Examiner*—Daniel Robinson
(74) *Attorney, Agent, or Firm*—Renner, Otto, Boisselle & Sklar, LLP

(57) ABSTRACT

A high-frequency heating apparatus comprises a heating chamber, a high-frequency generator, a waveguide, an antenna, a motor for rotating the antenna, and a stage (6) provided above and near the antenna to partition the heating chamber and made of dielectric. A rotary base on which an object to be heated is mounted is provided on the stage. A first magnet is provided to the antenna. A second magnet is provided on the rotary base at a place corresponding to the first magnet on the rotary base. By utilizing the magnetic coupling between the first and second magnets, the rotary base is rotated in synchronism with the rotation of the antenna. While maintaining the advantages of conventional antenna high-frequency heating apparatuses, the heating efficiency by grill heating or oven heating is enhanced, and minute heating uniformness is achieved.

29 Claims, 29 Drawing Sheets

HIGH-FREQUENCY HEATING APPARATUS

TECHNICAL FIELD

The present invention relates to a high-frequency heating apparatus (hereinafter also referred to as a "microwave oven"), and more particularly to an antenna-type high-frequency heating apparatus.

BACKGROUND ART

Roughly speaking, uniform heating inside the heating compartment of a microwave oven is achieved by the use of a turntable, stirrer, or antenna. Now, a brief description will be given of how uniform heating is achieved by the use of each of these. Where a turntable is used, a heating target is placed on the turntable provided on the floor of the heating compartment, and the turntable is rotated. Thus, the high-frequency wave radiated into the heating compartment through an opening formed on a side wall surface or the ceiling surface thereof strikes the heating target uniformly from all directions, thereby heating it. This is the method that is currently most commonly used in microwave ovens. FIGS. 32 and 33 are a sectional view and a perspective view, respectively, of an example of a microwave oven adopting this method. A motor 5 is provided on the outside of the floor of the heating compartment 1, and the spindle 51 of this motor 5 penetrates the floor of the heating compartment 1 through a hole formed thereon so as to protrude inward from the floor of the heating compartment 1. On this spindle 51 protruding from the floor of the heating compartment 1, a disk-shaped turntable T is pivoted so that, as the motor 5 is driven, the turntable T rotates. On the other hand, the high-frequency wave radiated from a magnetron (high-frequency generator) 2 is guided through a waveguide 33, and is then radiated into the heating compartment 1 through an opening 101 formed on the side surface of the heating compartment 1. Thus, the high-frequency wave strikes the heating target (not illustrated) placed on the rotating turntable T, thereby heating it. The turntable T may instead be driven with magnetic coupling as disclosed in, for example, Japanese Patent Application Published No. S61-13359 and Japanese Patent Applications Laid-Open Nos. S58-220387 and S59-14294.

Where a stirrer is used, typically, as shown in FIGS. 34 and 35, a metal high-frequency wave diffusing wheel is provided as the stirrer in this case, close to the heating compartment 1, inside an opening 101 formed in the ceiling surface of the heating compartment 1. This wheel is rotated with a motor 31 so that, as the high-frequency wave radiated from a magnetron 2 is radiated into the heating compartment 1 through the opening 101, the intensity of the electromagnetic field of the high-frequency wave is varied by diffusion by the rotating wheel. With this method, uniform heating is possible with no movement in the heating target. The heating target is placed on a stage T' substantially rectangular in shape and made of a dielectric material (typically glass, ceramic, or the like).

Where an antenna is used, for example as shown in FIG. 36, while, on one hand, the high-frequency wave radiated from a magnetron 2 is guided through a waveguide 3 to the outside of the floor of the heating compartment 1, the receiver portion 41 of an antenna 4 is put through an opening 11 formed on the floor of the heating compartment 1 so as to protrude into the waveguide 3 so that, on the other hand, the high-frequency wave inside the waveguide 3 is propagated from the receiver portion 41 to the radiator portion 42 of the antenna 4. This radiator portion 42 of the antenna 4 is rotated with a motor 5 so that the high-frequency wave heats the heating target uniformly (for example, as disclosed in Japanese Patent Application Laid-Open No. H11-8057). The heating target is placed on a stage 6 that is provided above and close to the antenna so as to partition the interior of the heating compartment 1 and that is made of a dielectric material (typically glass, ceramic, or the like). This method permits the heating target to be placed near the radiator portion 42 of the antenna 4 from which the high-frequency wave is radiated, and is thus superior to the other methods in heating efficiency. Today, this method is becoming increasingly widespread in microwave ovens for use in convenience stores and other food processing and selling businesses.

Of these different methods for uniform heating of a heating target, whereas that using a turntable keeps the heating target rotating while it is heated, that using a stirrer and that using an antenna keep it at rest while it is heated. From the viewpoint of uniform heating, it is generally believed that the methods using a turntable, an antenna, and a stirrer are the best, second-best, and third-best, respectively.

From the viewpoint of the area inside the heating compartment which can be used for the placement of the heating target, however, whereas the method using a turntable only offers the area of the turntable itself, that using a stirrer and that using an antenna, which require no movement in the heating target, offer the whole area of the floor of the heating compartment. Thus, the latter two permit more efficient use of the heating compartment, and accordingly permit more of the heating target to be heated at a time, provided that the volume of the heating compartment is equal.

From the viewpoint of easy cleaning of the floor of the heating compartment, the method using a turntable with magnetic coupling and that using a stirrer does not need through holes formed on the floor of the heating compartment, and thus permits comparatively easy cleaning of the floor of the heating compartment because this surface is largely flat once the turntable or stage is removed. Also with the method using an antenna, the stage provided fixedly above the antenna virtually serves as the floor wall of the heating compartment, and the surface of this stage is extremely easy to clean because it is not only flat but also made of a dielectric material such as glass or ceramic.

In recent years, increasingly high importance has come to be placed on heating efficiency, efficient use of the interior volume of the heating compartment, and easy cleaning of the heating compartment. This trend has been accompanied by revaluation of antenna-type microwave ovens for household use.

Incidentally, some recently developed microwave ovens are given composite functions by being equipped for, as well as heating using a high-frequency wave, grill heating and oven heating using a heater. Grill heating is achieved by the use of a glass-tube heater or sheath heater provided on the ceiling of the heating compartment, off the center thereof. With this heater heated so that its surface temperature is 600° C. or higher, the heating target is rotated so that it as a whole is roasted uniformly and quickly.

On the other hand, in a conventional antenna-type microwave oven, the heating target remains at rest on the stage, and therefore, to give the microwave oven composite functions, for example by adding thereto a capability of grill heating, a heater H needs to be arranged over the entire ceiling surface of the heating compartment 1. Arranging the heater H over the entire ceiling surface, however, results in the heater H occupying a large area. This lowers the temperature to which the heater H can be heated, and increases the duration for which it needs to be heated. Disadvantageously, the heating duration cannot be shortened without increasing the power consumption by the heater.

Moreover, the method using an antenna, just because it keeps the heating target at rest, occasionally produces unsatisfactory results in the preparation of, for example, egg dishes such as chawan-mushi, a Japanese egg-based pot-steamed hotchpotch, which require delicately controlled uniform heating.

Other modern microwave ovens are equipped with stirring foodstuffs. With these, the entire procedure for preparing a dish, for example a stewed dish such as curried stew, or for preparing dough for bread can be gone through continuously, from the preparation of ingredients up to the heating and finishing of the target dish. An example of this type of microwave oven is shown in FIG. 38. The microwave oven shown in FIG. 38 has a turntable, which can be interchanged with a container 8 having a stirring wheel 83 inside it. When this container 8 is placed inside the heating compartment 1, the rotary shaft 82 of the stirring wheel 83 is coupled with the spindle 51 of the motor 5 for rotating the turntable. As the stirring wheel 83 is rotated inside the container 8, it stirs the foodstuffs put therein (for example, as disclosed in Japanese Patent Applications Laid-Open Nos. H10-211098 and H11-121161).

On the other hand, in a conventional antenna-type microwave oven, there is provided no mechanism for driving a stirring wheel. This makes it impossible to add thereto a function of automatic stirring.

DISCLOSURE OF THE INVENTION

In view of the conventionally experienced problems mentioned above, it is an object of the present invention to provide an antenna-type microwave oven that, while maintaining the advantages it has conventionally had, offers enhanced heating efficiency in grill heating and oven heating and permits delicately controlled uniform heating.

It is anther object of the present invention to provide an antenna-type microwave oven that is capable of automatically stirring foodstuffs put in a container placed in the heating compartment.

To achieve the above objects, according to the present invention, a high-frequency heating apparatus is provided with: a heating compartment in which a heating target is heated; a high-frequency wave generator that generates a high-frequency wave; a waveguide through which the high-frequency wave generated by the high-frequency wave generator is guided to an opening formed on the heating compartment wall; a freely rotatable antenna that feeds the high-frequency wave inside the waveguide into the heating compartment through the opening and that has a receiver portion and a radiator portion; a motor that rotates the antenna; and a stage that is provided above and close to the antenna so as to partition the interior of the heating compartment and that is made of a dielectric material. In this high-frequency heating apparatus, a rotary member is placed on the stage, and either magnets are provided on both the rotary member and the antenna, or a magnet is provided on one of the rotary member and the antenna and a magnetic material is provided on the other, so that the magnetic coupling between the antenna and the rotary member is exploited to rotate the rotary member as the antenna rotates.

Here, from the viewpoint of permitting rotatable placement of the heating target in an antenna-type microwave oven, enhancing the heating efficiency in grill heating and oven heating, and permitting uniform high-frequency heating of the heating target, it is preferable to use, as the rotary member, a rotary stage provided with: a support member having a plurality of rollers and magnets; and a table that is supported on the support member and on which the heating target is placed. Moreover, to permit the table to rotate faster than the antenna, it is preferable that the table be supported on the plurality of rollers by being kept in contact therewith so that, as the rollers rotate, the table rotates.

From the viewpoint of mechanical strength and durability, it is preferable that the support member be made of metal. In this case, it is preferable that the support member have openings or cuts formed therein through which to pass the high-frequency wave radiated from the antenna.

The rotary member may be a stirring member provided in a container placed on the stage. This, while maintaining the advantage of an antenna-type microwave oven that the floor of the heating compartment has a flat surface without holes and is thus easy to clean, makes it possible to stir with the stirring member the foodstuffs put in the container placed in the heating compartment.

To permit smooth rotation of the stirring member inside the container, and to achieve effective stirring of the heating target, it is preferable that the stirring member be provided with: a disk-shaped base; a stirring wheel that is formed on the base; and two or more rollers pivoted in a peripheral portion of the base.

From the viewpoint of preventing surface contact between the radiator portion of the antenna and the bottom surface of the stage and thereby achieving smooth rotation without friction thereof, and in addition precisely controlling the distance between the radiator portion of the antenna and the bottom surface of the stage and the length over which the receiver portion of the antenna protrude into the waveguide, it is preferable to provide a restricting member on at least one of the antenna and the stage in order to restrict the movement of the antenna in the axial direction. Preferably, the antenna is composed of a cylindrical receiver portion and a substantially disk-shaped radiator portion fitted at the top end of the receiver portion coaxially therewith, and the restricting member is formed on the top surface of the radiator portion of the antenna at equal angular intervals in the circumferential direction.

From the viewpoint of preventing magnetic attraction between the magnet fitted on the antenna and the floor, made of a magnetic material, of the heating compartment and thereby achieving smooth rotation of the antenna, it is preferable that the side of the magnet fitted on the antenna which faces the stage be covered with a nonmagnetic member, and that the side of the same magnet which faces the floor of the heating compartment be covered with a magnetic member. Here, when the antenna is formed of a nonmagnetic member, it is preferable that the magnet be provided on the bottom surface of the antenna, and that the surface of the magnet be covered with a magnetic member. By contrast, when the antenna is formed of a magnetic member, it is preferable that the magnet be provided on the top surface of the antenna, and that the surface of the magnet be covered with a nonmagnetic member.

For the purpose of browning the heating target and for other purposes, a heater is sometimes brought close to the periphery of the antenna and operated with the antenna stationary. In this case, the magnet fitted on the antenna is locally exposed to high temperature. In general, a magnet undergoes irreversible demagnetization at high temperature. Thus, the magnet, if demagnetized at high temperature, will weaken the magnetic coupling between the antenna and the rotary member, leading to loss of rotation of the rotary member. To avoid this, it is strongly recommended to rotate the antenna when the heater is operating in order to reduce the effect of the heat generated by the heater on the magnet fitted to the antenna.

It is preferable to keep the antenna rotating even after the heater stops being heated until a predetermined length of time elapses or until the temperature falls below a predetermined temperature. To permit the user to safely take out the heating target placed on the rotary member, it is preferable to provide a detector for detecting whether the door of the heating compartment is open or closed so that, when the door is opened after the heater stops being heated, the rotation of the antenna is stopped. On the other hand, when the rotary member is not used and the heating target is placed directly on the stage, even if the door is opened while the antenna is rotating after the heater stops being heated, the rotation of the antenna need not be stopped.

BEST MODE FOR CARRYING OUT THE INVENTION

Hereinafter, high-frequency heating apparatuses (microwave ovens) according to the present invention will be described with reference to the accompanying drawings. It should be understood that these embodiments are not meant to limit the invention in any way.

Figure 1:
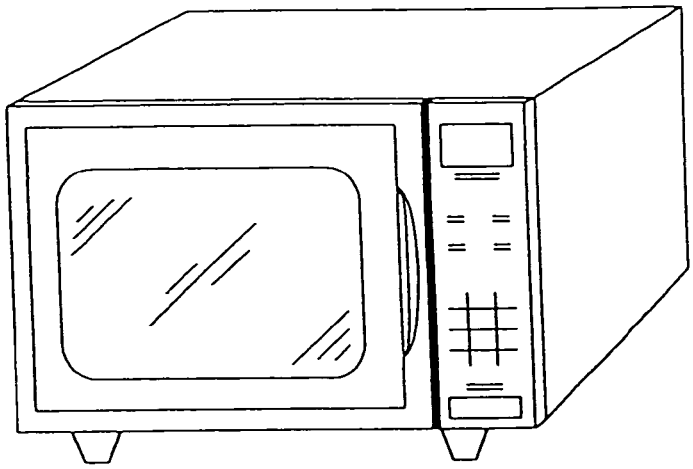
FIG. 1 is an exterior view showing an example of a microwave oven according to the invention.
Figure 2:
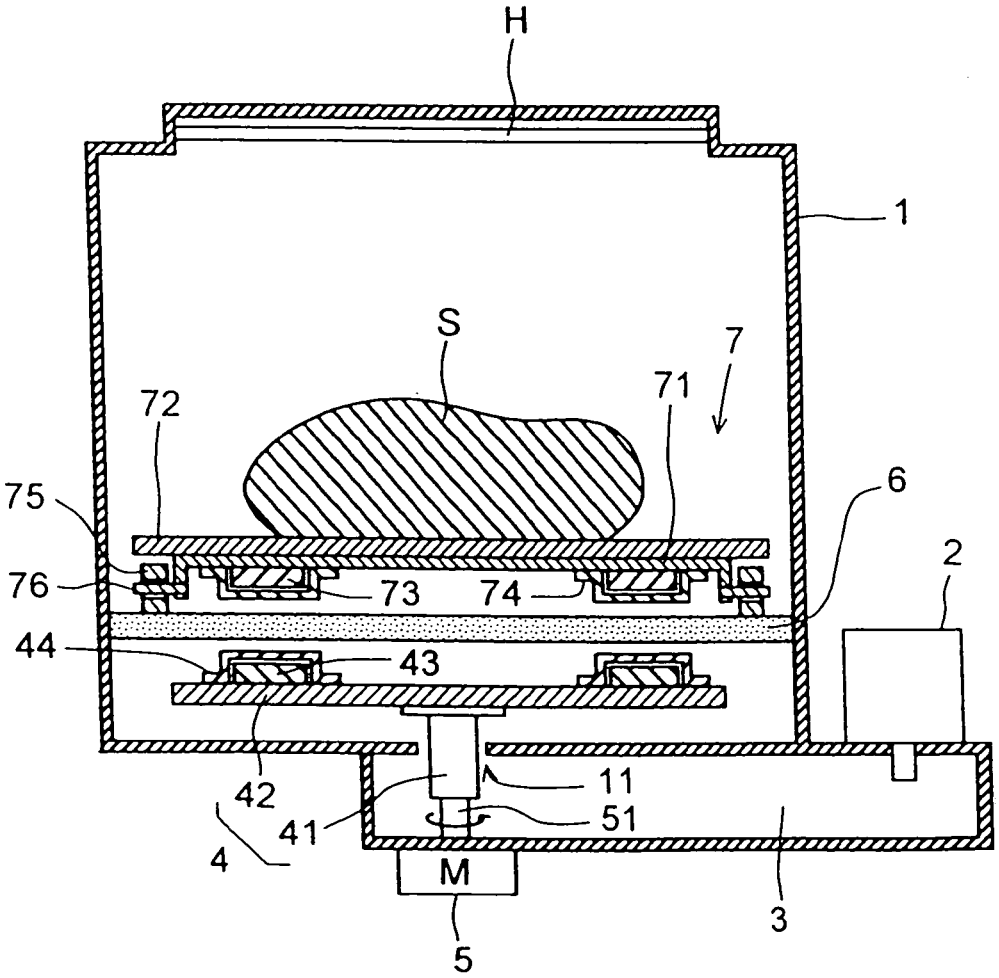
FIG. 2 is a front sectional view of the microwave oven of FIG. 1.
Figure 3:
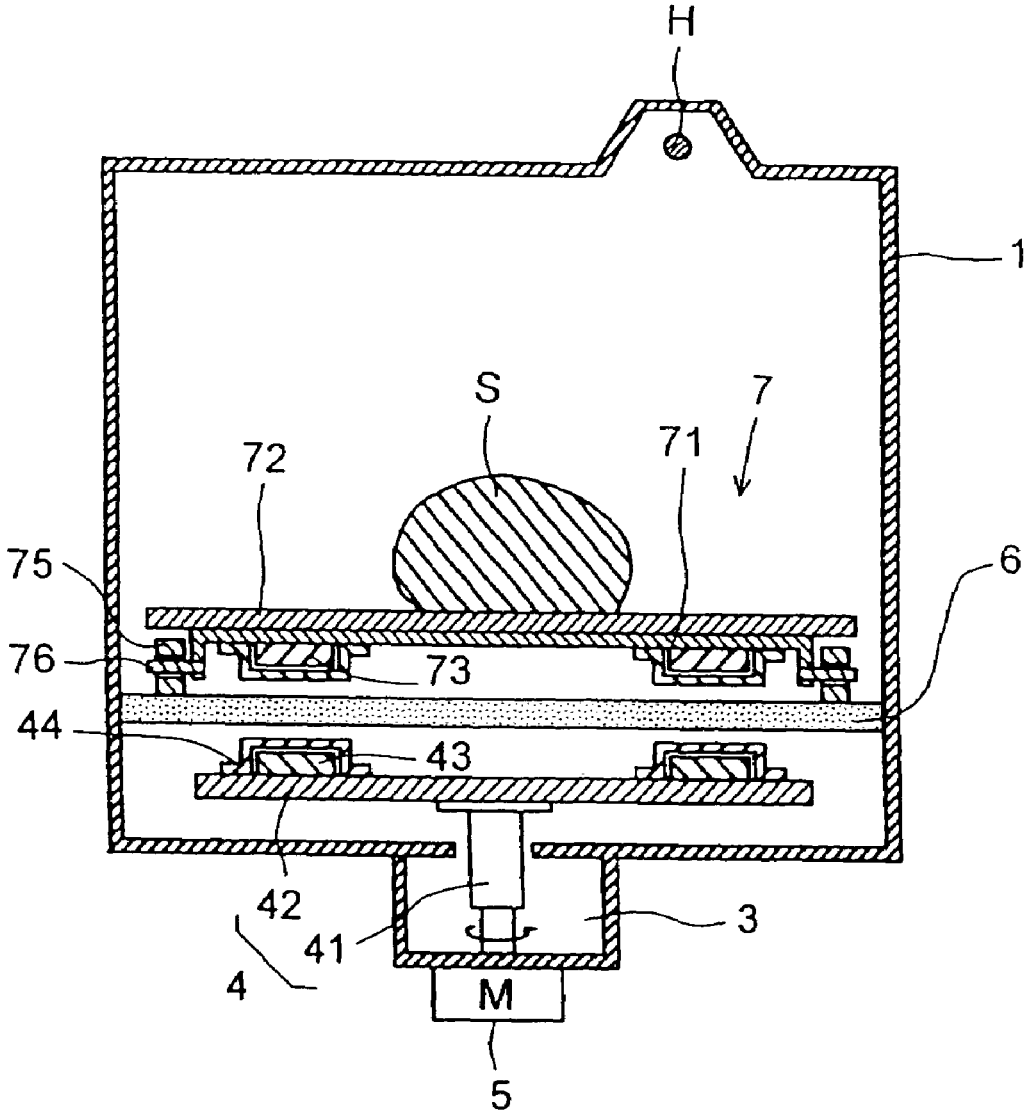
FIG. 3 is a side sectional view of the microwave oven of FIG. 1.

FIG. 1 is an exterior perspective view showing an example of a microwave oven according to the invention. FIGS. 2 and 3 are respectively a front sectional view and a side sectional view thereof. According to the invention, a microwave oven is provided with a heating compartment 1 made of metal and having a substantially rectangular shape, and a waveguide 3 provided on the outside of the floor of the heating compartment 1 so as to be adjacent thereto. At one end of the waveguide 3, a magnetron (high-frequency wave generator) 2 is fitted, and, at the other end of the waveguide 3, an opening 11 that leads to the heating compartment 1 is formed. On the floor portion of the heating compartment 1, an antenna 4 is provided. The antenna 4 is composed of a cylindrical receiver portion 41 and a disk-shaped radiator portion 42 fitted at the top end of the receiver portion 41. On the top surface of the radiator portion 42, first magnets 43 are arranged at equal angular intervals in the circumferential direction, and a protective member 44 is fitted so as to cover the first magnets 43.

The cylindrical receiver portion 41 is put through the opening 11 formed on the floor of the heating compartment 1 so as to protrude into the waveguide 3, and is connected, at the bottom end thereof, to the spindle of a motor 5 provided on the outside of the floor of the waveguide. Thus, as the motor 5 is driven, the antenna 4 rotates.

Inside the heating compartment 1, above and close to the antenna 4, a stage 6 is fitted so as to partition the interior of the heating compartment 1. This stage 6 is made of a dielectric material such as glass or ceramic so as to transmit high-frequency waves. As will be described later, when a heating target is heated by high-frequency heating alone, the heating target S is placed directly on the stage 6. Made of glass, ceramic, or the like, the stage 6 has a smoother surface than a metal member, and is thus far easier to clean.

On the top surface of the stage 6, a rotary stage (rotary member) 7 having a heating target S placed thereon is placed. The rotary stage 7 has a disk-shaped support member 71 and a table 72 supported on the top surface of the support member 71. On the peripheral wall of the support member 71, a plurality of rollers 75 are pivoted on shafts 76. On the bottom surface of the support member 71, second magnets 73 are fitted in positions corresponding to the first magnets 43, and a protective member 74 is fitted so as to cover them. Thus, as the antenna 4 rotates, thanks to the magnetic coupling between the first magnets 43 and the second magnets 73, the support member 71 rotates together, with the result that the table 72 supported on the support member 71 also rotates. Here, the magnetic coupling can be obtained even when either the first magnets 43 or the second magnets 73 are replaced with pieces of a magnetic material. On the ceiling of the heating compartment 1, off the center thereof, a heater H used for grill heating is fitted.

Figure 6:
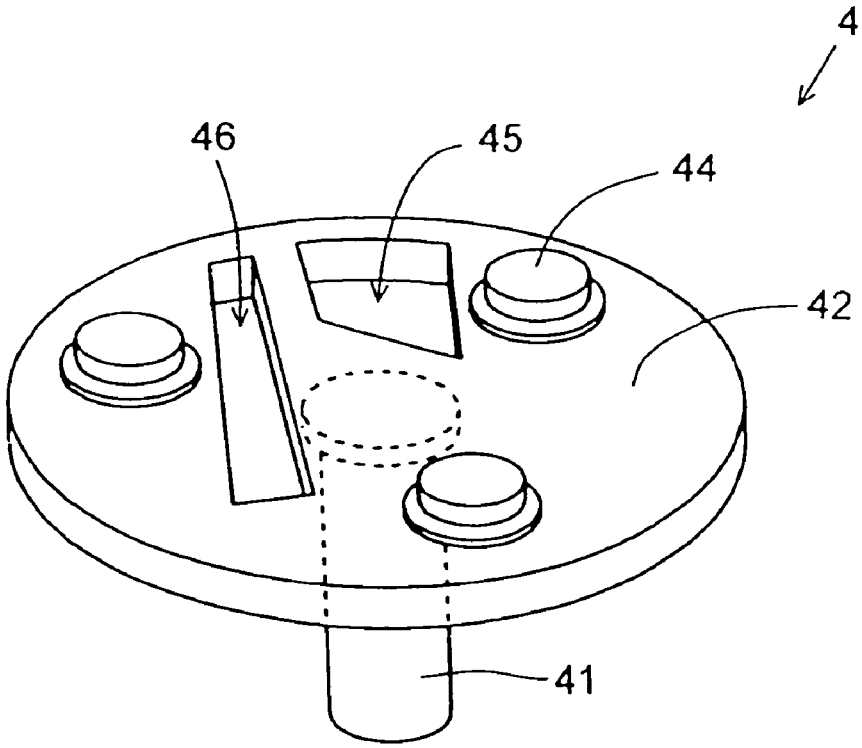
FIG. 6 is a perspective view showing an example of the antenna.

In the microwave oven constructed as described above, the high-frequency wave generated by the magnetron 2 is guided through the waveguide 3 to the receiver portion 41 of the antenna 4. The high-frequency wave is then propagated from the receiver portion 41 to the radiator portion 42, and is then radiated into the heating compartment 1. Here, the radiator portion 42 is rotated by the motor 5, and this permits the high-frequency wave to be radiated uniformly into the heating compartment. FIG. 6 is a perspective view showing an example of the antenna. In the antenna shown in this figure, the high-frequency wave is radiated mainly from the edges of openings 45 and 46 formed in the radiator portion 42. Needless to say, the antenna 4 may be given any other shape than specifically shown here: it may be in the shape of, for example, a bar or an elongate plate.

Figure 4:
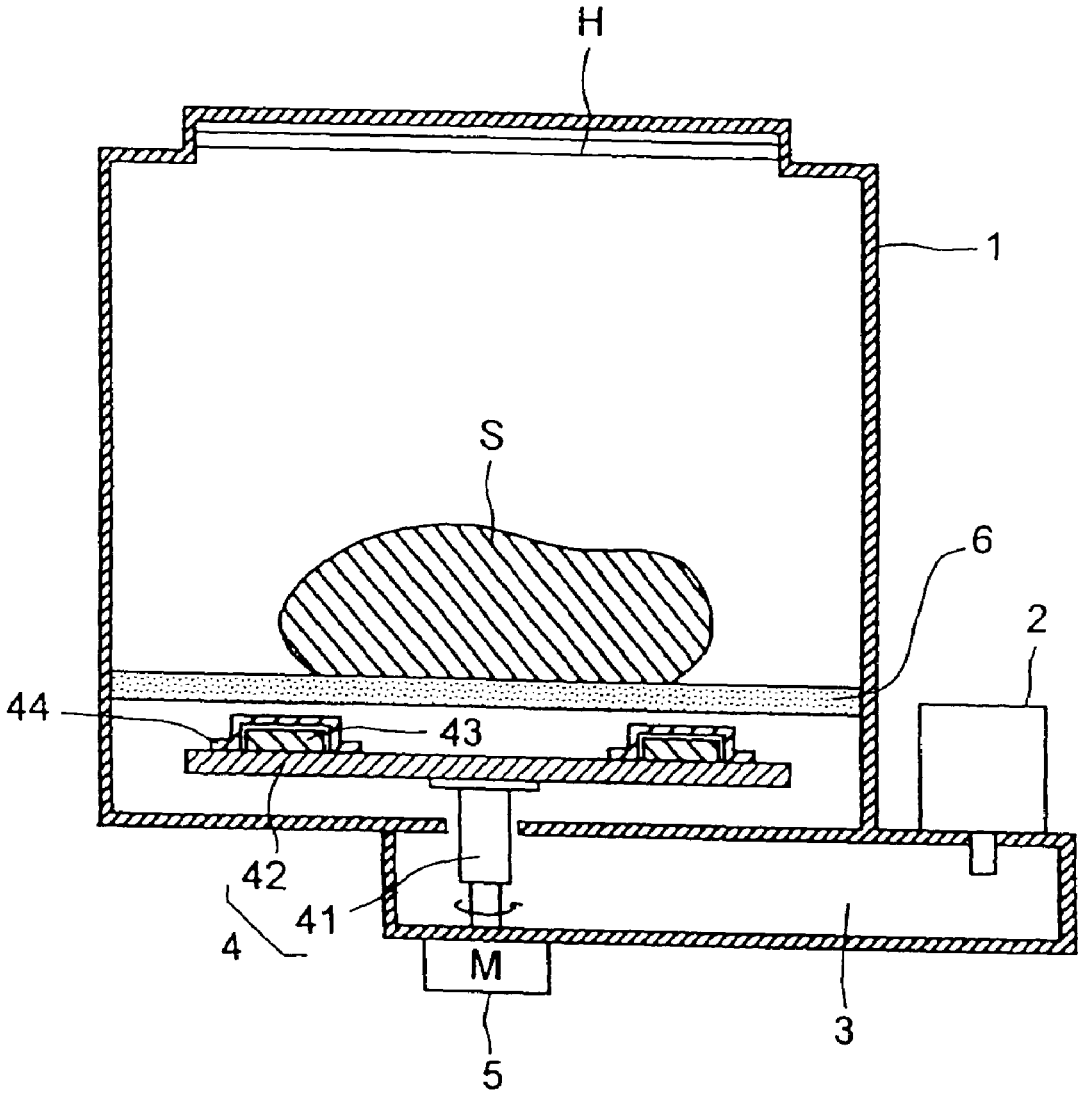
FIG. 4 is a diagram showing how high-frequency heating is performed with the heating target placed on the stage

The high-frequency wave radiated from the radiator portion 42 of the antenna 4 is transmitted through the stage 6, and then strikes, directly or after being reflected off the inner walls of the heating compartment, the heating target S, thereby heating it. Here, when the heating target S is heated with the high-frequency wave alone, as shown in FIG. 4, the rotary stage 7 is removed from the heating compartment 1, and high-frequency heating is performed with the heating target S placed on the stage 6. In this way, the advantages that an antenna-type construction has conventionally had are maintained. Specifically, as described earlier, the antenna 4 rotates right below the stage 6 on which the heating target S is placed, and thus the antenna 4 permits the high-frequency wave to strike the heating target S uniformly, thereby heating it uniformly. Moreover, in this case, the entire space inside the heating compartment 1 can be efficiently used.

Figure 5:
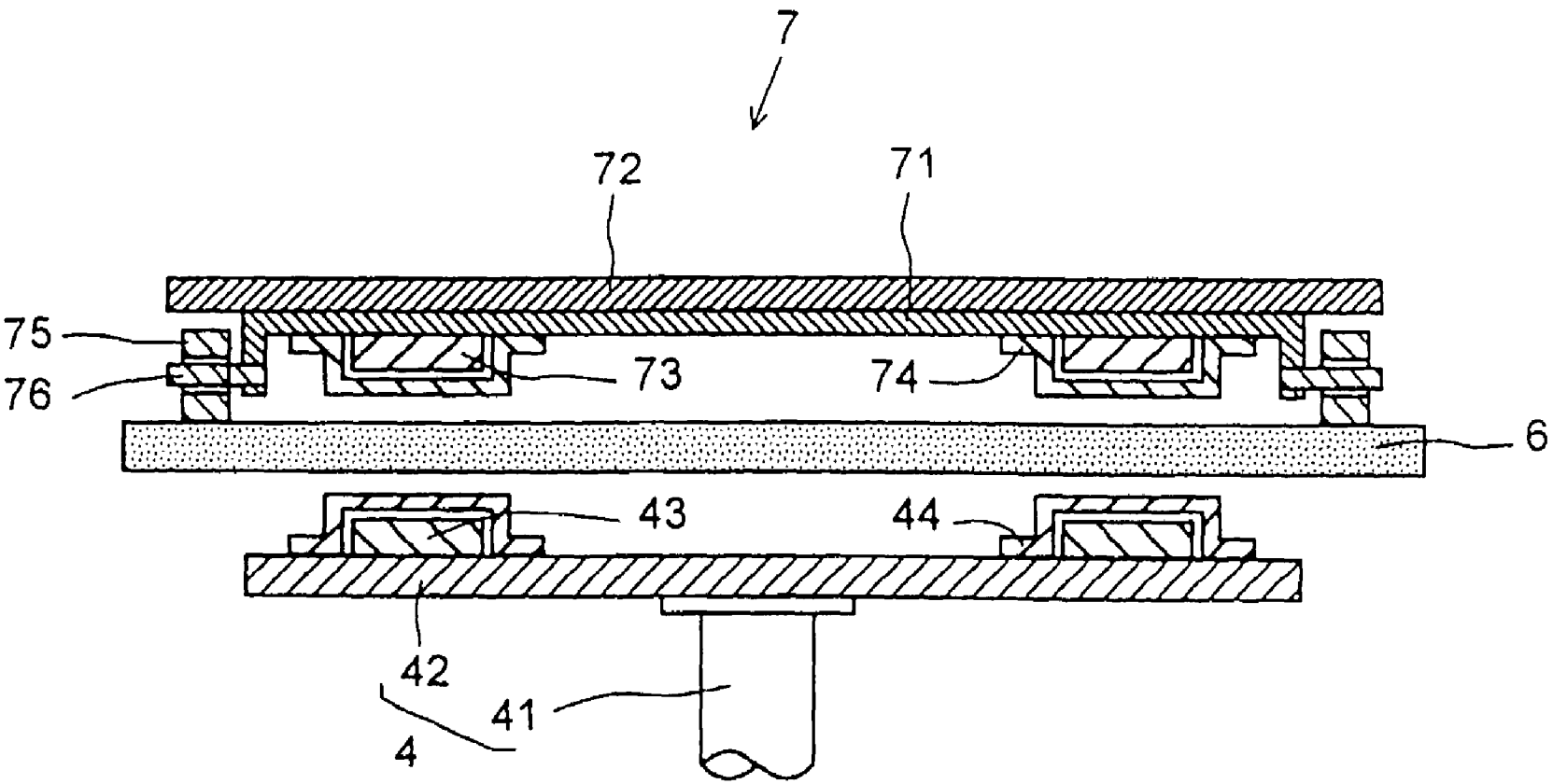
FIG. 5 is a diagram showing how the antenna and the table rotate at the same speed.

On the other hand, when grill heating is performed, as shown in FIG. 2, the rotary stage 7 is placed on the stage 6, and the heating target S is placed on the table 72 of the rotary stage 7. When, as the motor 5 is driven, the antenna 4 rotates, thanks to the magnetic coupling between the first magnets 43 and the second magnets 73, the support member 71 along with the table 72 rotates together. Since, as shown in FIG. 3, the heater H for grill heating is arranged in a position slightly deviated rightward from the center of the heating compartment 1, by rotating the heating target 1, it as a whole can be heated uniformly with the heater H. In grill heating, rotating the table 72 and the antenna 4 at the same speed does not affect the heating performance, and therefore, as shown in FIG. 5, the table 72 is supported on the support member 71 in such a way that the bottom surface of the table 72 does not make contact with the rollers 75 of the support member 71.

Figure 7:
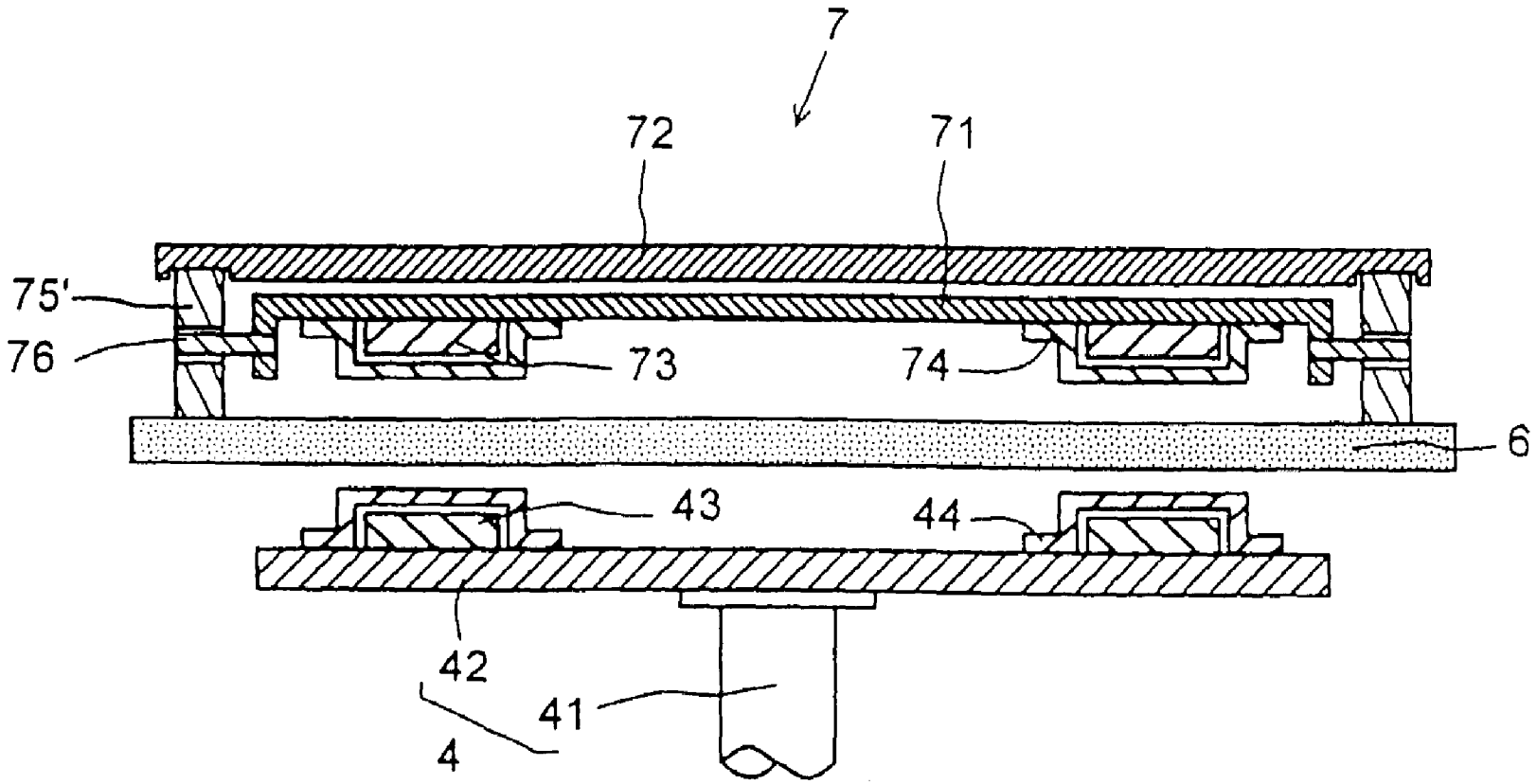
FIG. 7 is a diagram showing how the antenna and the table rotate at different speeds.

When high-frequency heating and grill heating are performed together, as in combined grill heating, the heating target S is placed on the table 72 of the rotary stage 7, and the magnetic coupling between the first magnets 43 and the second magnets 73 is exploited so that, as the antenna 4 rotates, the rotary stage 7 rotates together. In this case, however, the antenna 4 and the table 72, on which the heating target S is placed, need to be rotated at different speeds. This is because, if the antenna 4 and the table 72 are rotated at the same speed, the high-frequency wave radiated from the antenna 4 strikes only a particular part of the heating target S. The antenna 4 and the table 72 can be rotated at different speeds, for example, in the following manner. As shown in FIG. 7, the bottom surface of the table 72 is kept in contact with the rollers 75 fitted on the peripheral wall of the support member 71 so that the rollers 75 supports the table 72 and simultaneously permits it to rotate. With this construction, while the support member 71 rotates at the same speed as the antenna 4, the table 72 supported on the rollers 75 of the support member 71 rotates at twice the rotation speed of the antenna 4. Thus, the heating target S on the table 72 is as a whole heated uniformly. Likewise, also in a case where high-frequency heating alone is used and the rotary stage 7 is used, the antenna 4 and the table 72 are rotated at different speeds.

Figure 8:
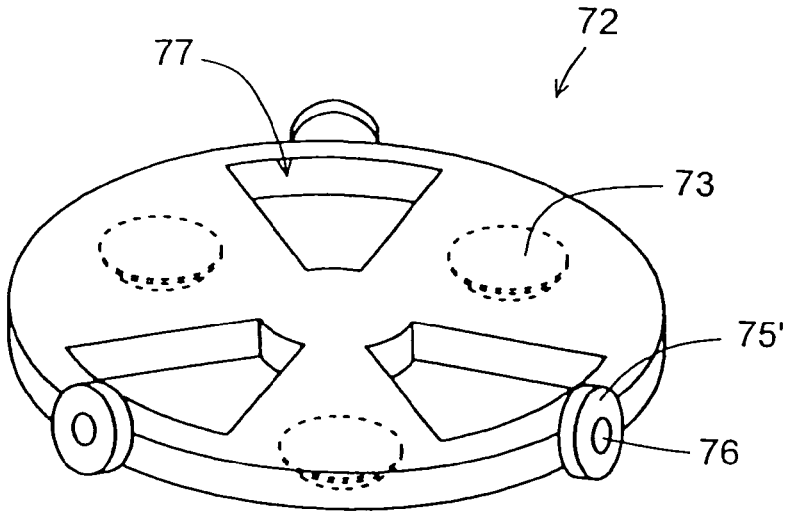
FIG. 8 is a perspective view showing an example of the support member.
Figure 9:
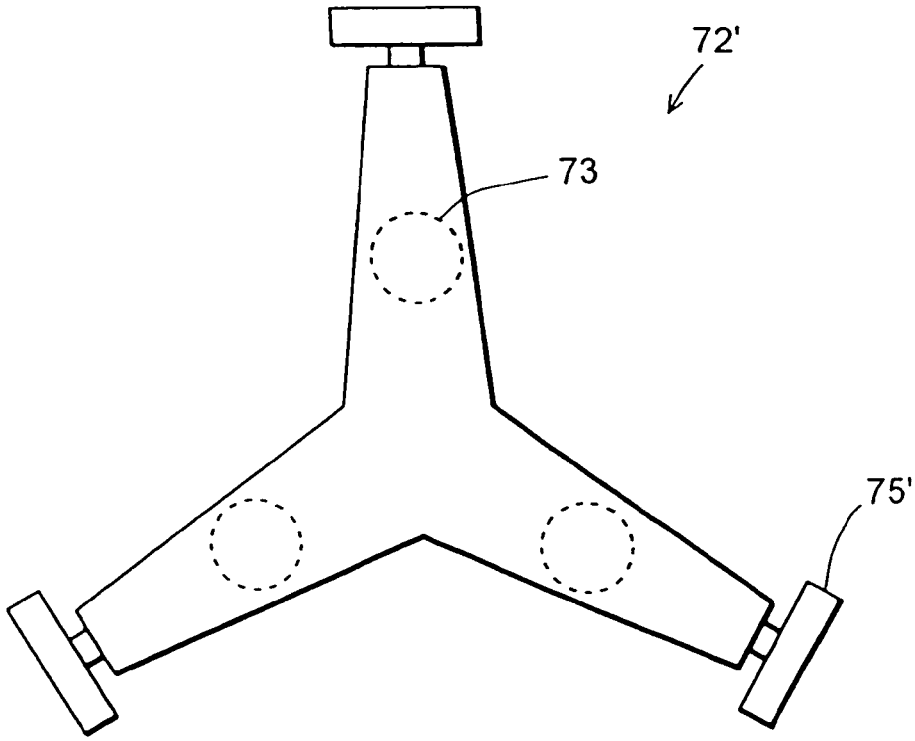
FIG. 9 is a perspective view showing another example of the support member.

Considering the heat resistance and the mechanical strength required during heating using the heater, it is preferable that the support member 71 used in the invention be made of a metal. In this case, however, since a metal material does not transmit high-frequency waves, it is preferable that the support member 71 have, for example, openings 77 formed therein through which to permit the passage of the high-frequency wave as shown in FIG. 8, or parts thereof cut out elsewhere than in the structurally necessary part thereof to leave open spaces as shown in FIG. 9.

On the other hand, for high-frequency heating, the table 72 used in this invention may be made of any material so long as it does not stop high frequency waves. From the viewpoint of mechanical strength and easiness of cleaning, it is recommended that the table 72 be made of glass, ceramic, or the like. In contrast, for grill heating and convection heating, it is preferable to use a table made of a nonmagnetic metal.

Figure 10:
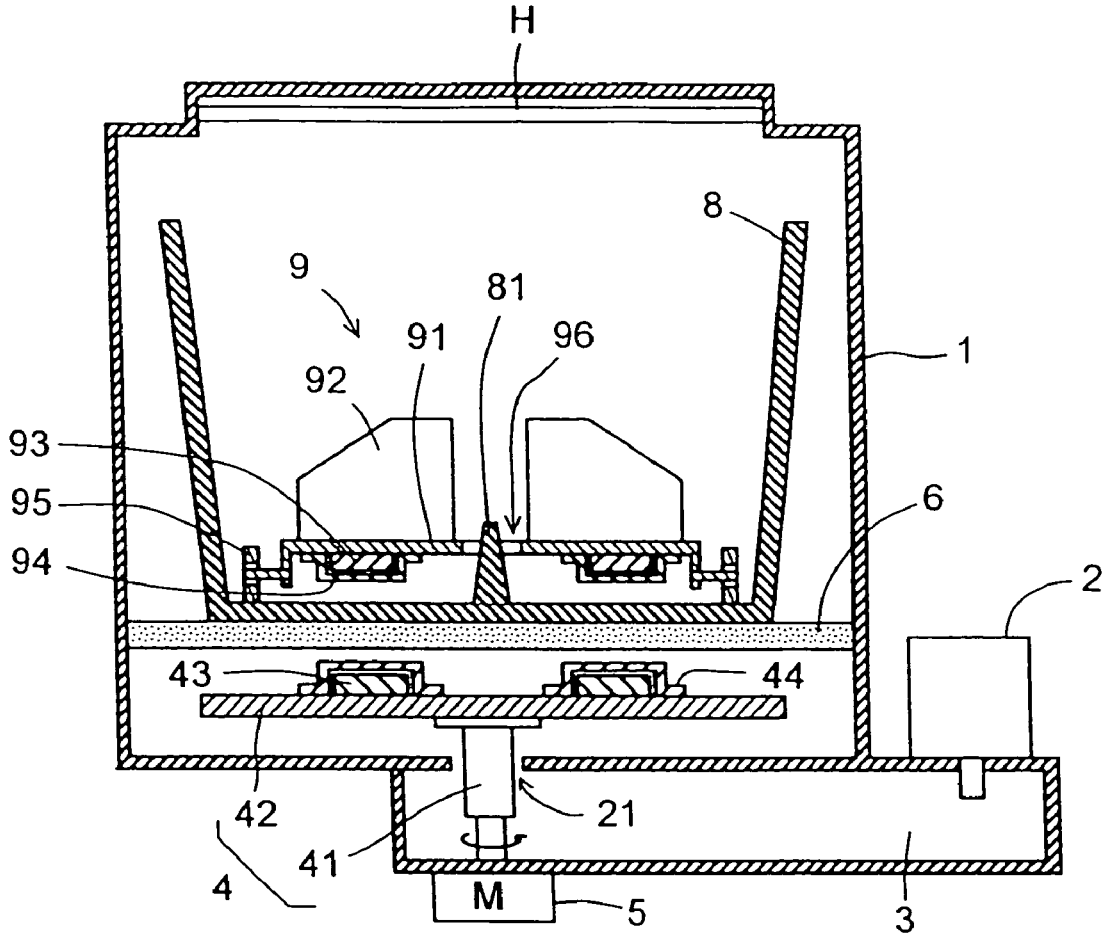
FIG. 10 is a front sectional view showing another embodiment of a microwave oven according to the invention.

Next, another example of a microwave oven according to the invention will be described. An outstanding feature of this microwave oven is that magnetic coupling is exploited to permit a stirring member (rotary member) arranged inside a container to rotate as an antenna rotates. FIG. 10 is a front sectional view showing an example of a microwave oven according to this invention. It should be noted that, in the following description, no explanations will be repeated of such components and structures as are found also in the microwave oven of FIG. 1, and chiefly differences therefrom will be discussed.

On the stage 6, a stirring container (rotary member) 8 made of a dielectric material is mounted, and, inside this stirring container 8, a stirring member 9 is arranged. The stirring member 9 is provided with a disk-shaped base 91, a stirring wheel 92 arranged upright on the top surface of the base, and rollers 95 pivoted in a peripheral portion of the base 91. At the center of the base 91, a through hole 96 is formed, and though this through hole 96, a projection 81 formed at the center of the floor of the stirring container 8 is inserted. Thus, the stirring member 9 is fitted inside the stirring container 8 so as to be rotatable about the projection 81. Moreover, on the bottom surface of the base 91, in positions corresponding to the first magnets 43 arranged on the top surface of the antenna 4, second magnets 93 are fitted.

With the microwave oven constructed as described above, a heating target can be heated while it is stirred in the following manner. First the heating target (not illustrated) is put in the stirring container 8, and then the motor 5 is driven to rotate the antenna 4. Now, thanks to the magnetic coupling between the first magnets 43 and the second magnets 93, as the antenna 4 rotates, the stirring member 9 inside the stirring container 8 rotates together. Thus, the stirring wheel 92 of the stirring member 9 stirs the heating target. In this way, the heating target put in the stirring container 8 is heated by the high-frequency wave and is simultaneously stirred by the stirring member 9. With this microwave oven, the entire procedure for preparing a dish, for example a stewed dish such as curried stew, or for preparing dough for bread can be gone through continuously, from the preparation of ingredients up to the heating and finishing of the target dish.

Moreover, since the projection 81 formed at the center of the base of the stirring container 8 is inserted into the through hole 96 formed in the stirring member 9 so that the stirring member 9 is rotated about the projection 81, even when the stirring wheel 92 receives a strong resistance from the heating target, the center of the stirring member 9 does not become misaligned, nor do the first magnets 43 and the second magnets 93 become magnetically decoupled. This permits stable stirring.

Figure 11:
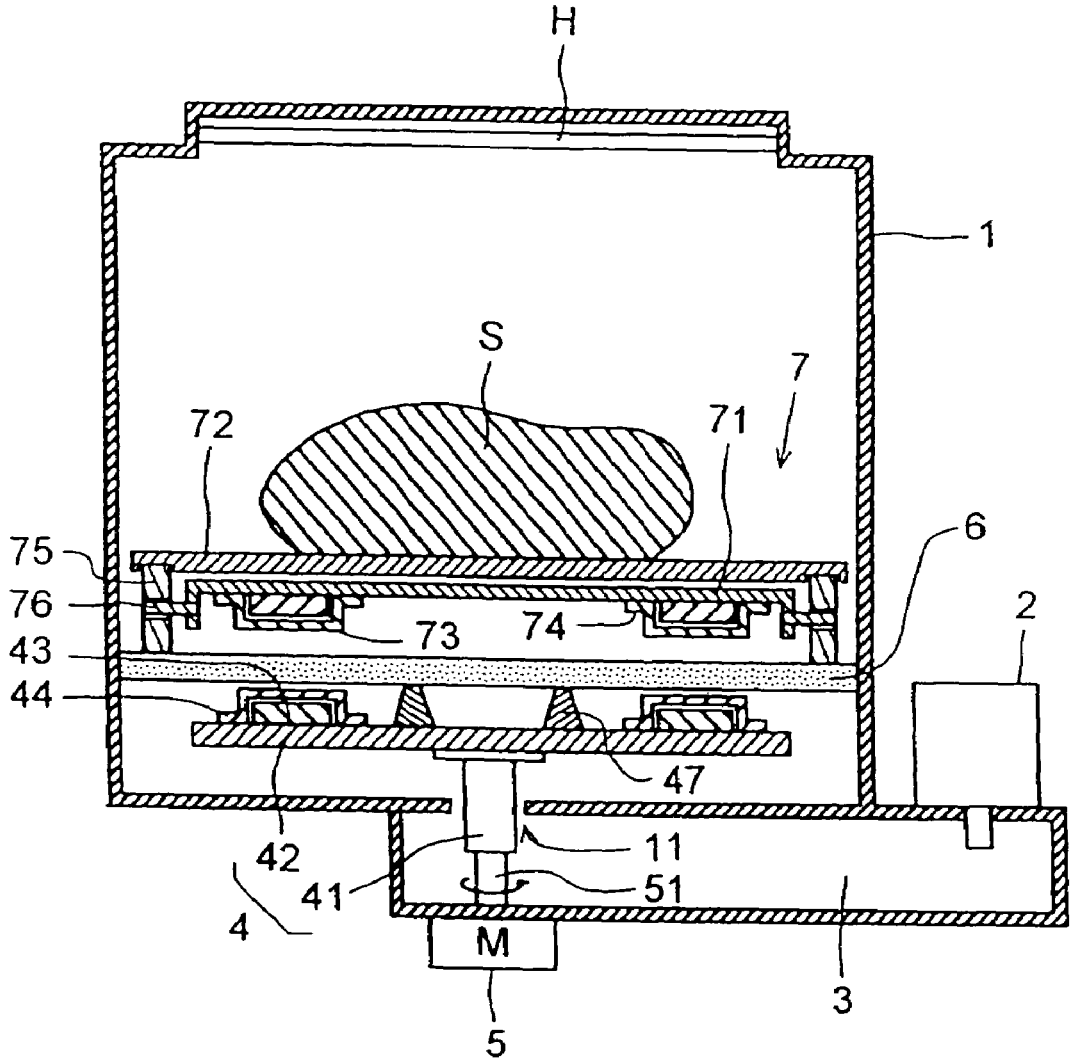
FIG. 11 is a front sectional view showing another example of a microwave oven according to the invention.

FIG. 11 shows another example of a microwave oven according to the invention. An outstanding feature of the microwave oven shown in FIG. 11 is that restricting members 47 for restricting the movement of the antenna 4 in the axial direction are provided on the top surface of the radiator portion 42. This prevents the magnetic coupling from causing the antenna 4 to move upward in the axial direction and make surface contact with the bottom surface of the stage 6. Moreover, restricting the movement of the antenna in the axial direction permits stable radiation of the high-frequency wave from the antenna. It should be noted that, in the following description, no explanations will be repeated of such components and structures as are found also in the microwave oven of FIG. 1, and chiefly differences therefrom will be discussed.

In the microwave oven of FIG. 11, projections (restricting members) 47 are provided on the top surface of the radiator portion 42 of the antenna 4 at equal angular intervals in the circumferential direction. With the rotary stage 7 placed on the stage 6, the magnetic attraction between the first magnets 43 and the second magnets 73 causes the antenna 4 to move upward, but the projections 47 formed on the top surface of the radiator portion 42 of the antenna 4 makes contact with the bottom surface of the stage 6, thereby preventing the radiator portion 42 from making surface contact with the stage 6.

Figure 12:
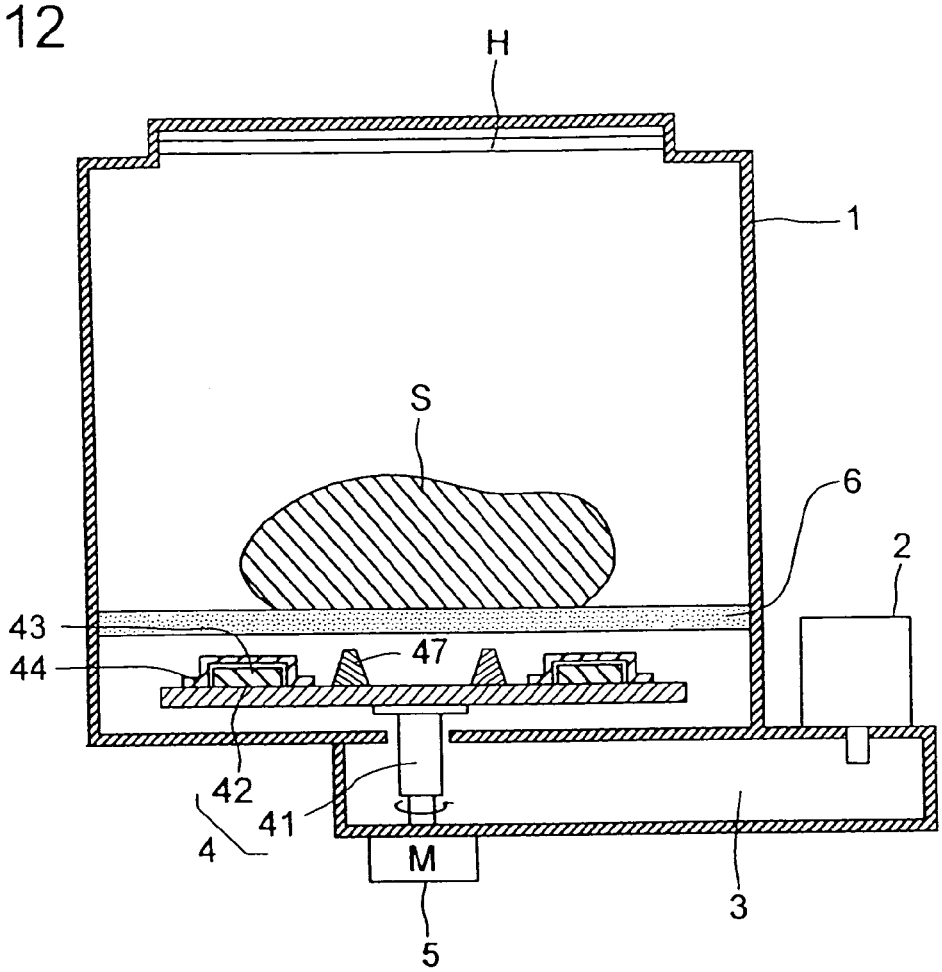
FIG. 12 is a front sectional view of a microwave oven, when the rotary member is not used.

When the heating target S is heated with the high-frequency wave alone, as shown in FIG. 12, the rotary stage 7 may be removed from the heating compartment 1 and high-frequency heating is performed with the heating target S placed directly on the stage 6. In this way, the advantages that an antenna-type construction has conventionally had are maintained. Specifically, as described earlier, the antenna 4 rotates right below the stage 6 on which the heating target S is placed, and thus the antenna 4 permits the high-frequency wave to strike the heating target S uniformly, thereby heating it uniformly. Moreover, in this case, the space inside the heating compartment 1 can be efficiently used. In this case, no magnetic attraction is working, and therefore the antenna 4, with its own weight, moves downward, with the projections 47 kept out of contact with the stage 6.

On the other hand, when grill heating or oven heating is performed, rotating the table 72 and the antenna 4 at the same speed does not affect the heating performance, and therefore the table 72 may be supported on the support member 71 in such a way that the bottom surface of the table 72 does not make contact with the rollers 75 of the support member 71.

Figure 13:
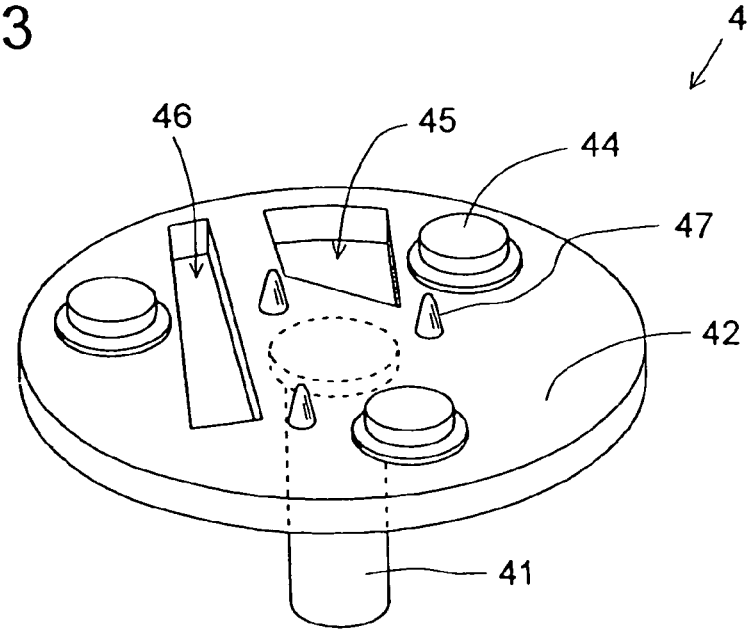
FIG. 13 is a perspective view showing an example of the antenna.

FIG. 13 is a perspective view of the antenna used in the microwave oven of FIG. 11. In this antenna, the high-frequency wave is radiated mainly from the edges of openings 45 and 46 formed in the radiator portion 42. Needless to say, the antenna 4 may be given any other shape than specifically shown here: it may be in the shape of, for example, a bar or an elongate plate.

Figure 14:
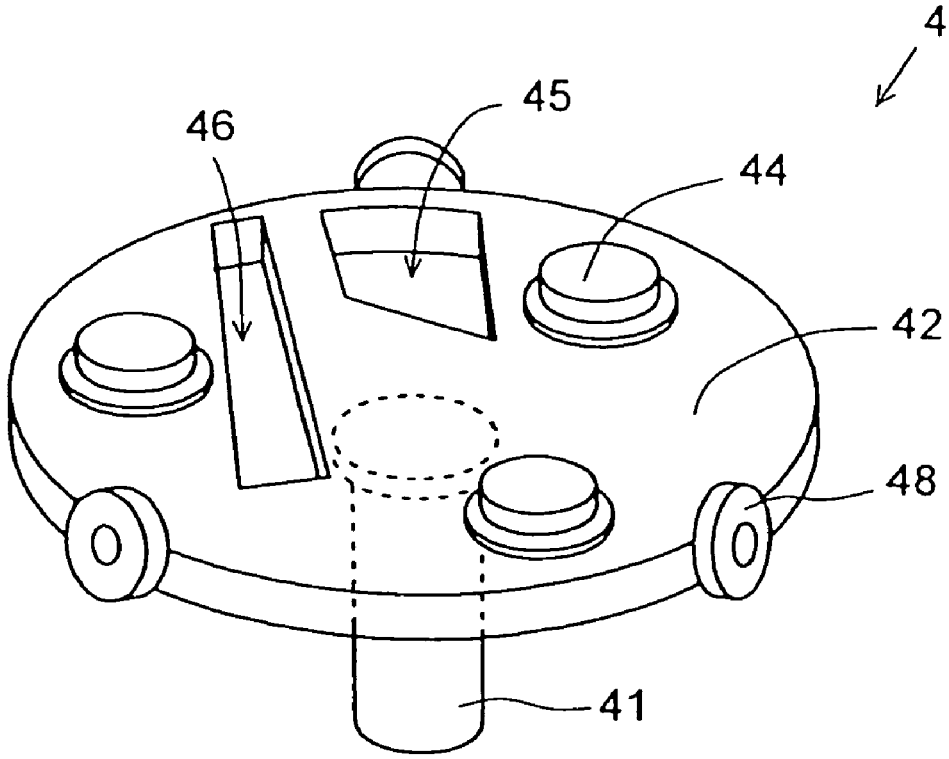
FIG. 14 is a perspective view showing another example of the antenna.
Figure 15:
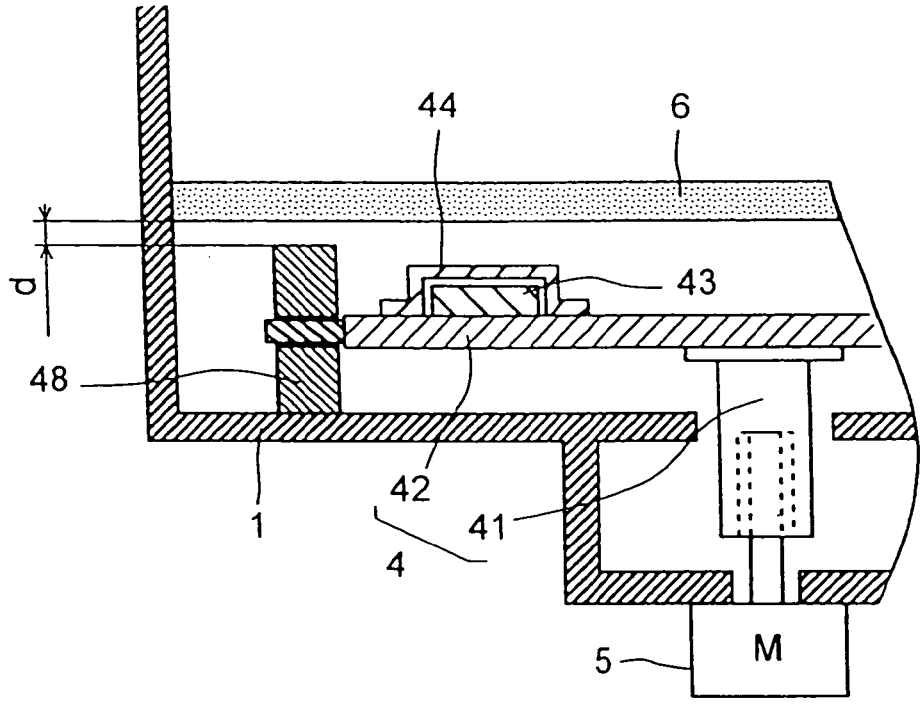
FIG. 15 is a partial sectional view, when the antenna of FIG. 12 is arranged in the microwave oven.

FIG. 14 shows another example of the antenna. In this antenna, used as the restricting members are rollers 48 that are pivoted at the periphery of the disk-shaped radiator portion 42. Specifically, the rollers 48 are fitted to the radiator portion 42 in such a way that the top ends of the rollers 48 come above the top surfaces of the radiator portion 42 and the protective member 44. FIG. 15 is a partial sectional view when this antenna is placed in the microwave oven. As will be clear from this figure, when the rotary stage 7 is not placed on the stage 6, there is left a gap d between the top ends of the rollers 48 and the stage 6, whereas the bottom ends of the rollers 48 are in contact with the floor of the heating compartment 1. When the microwave oven is used in this state, for example, by performing high-frequency heating alone, as the motor 5 is driven, the antenna 4 rotates, and thus the rollers 48 roll on the floor of the heating compartment 1. This keeps the radiator portion 42 and the floor of the heating compartment 1 parallel. Needless to say, the rollers 48 may instead be kept out of contact with the floor of the heating compartment 1.

Figure 16:
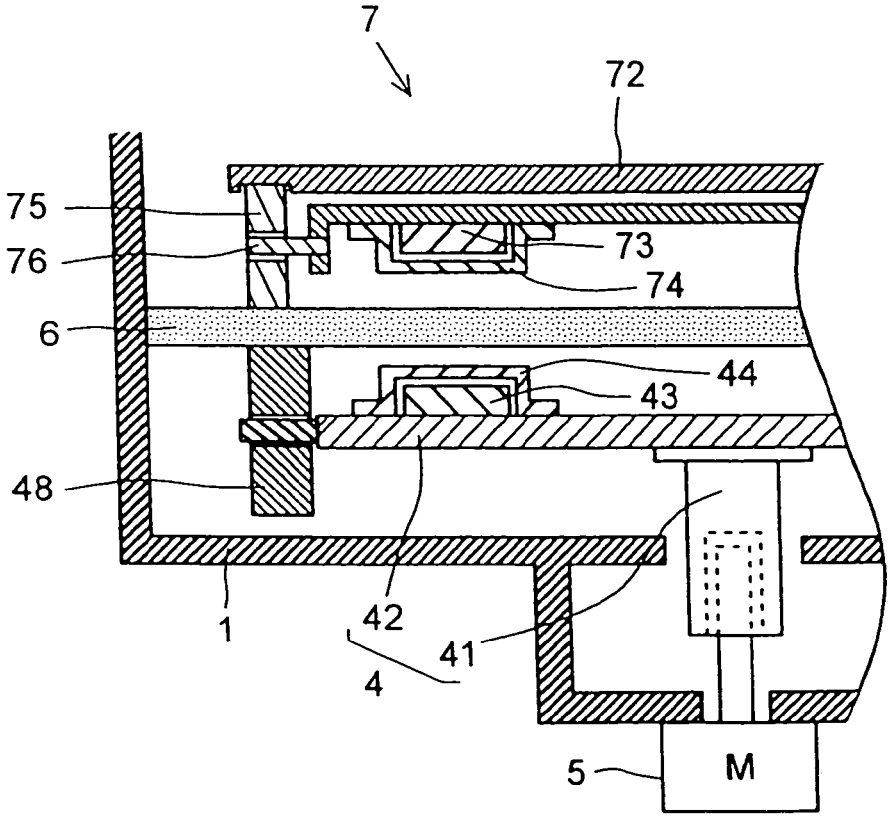
FIG. 16 is a partial sectional view, when the rotary stage is arranged in the apparatus of FIG. 13.

FIG. 16 shows a partial sectional view when the rotary stage 7 is placed on the stage 6. In this case, the magnetic attraction between the first magnets 43 and the second magnets 73 causes the antenna 4 to move upward in the axial direction, but the top ends of the rollers 48 pivoted at the periphery of the radiator portion 42 make contact with the bottom surface of the stage 6, thereby restricting the movement. Here, it is preferable that the movement distance of the antenna 4 in the axial direction be 5 mm or less. If the movement distance of the antenna 4 is more than 5 mm, the distance between the radiator portion 42 of the antenna 4 and the floor of the heating compartment 1 and the length over which the receiver portion 41 protrudes into the waveguide 3 vary too greatly, possibly leading to unstable radiation of the high-frequency wave. It is further preferable that the movement distance be 1 mm or less. In practice, the movement distance of the antenna can be adjusted by adjusting the gap d, shown in FIG. 15, between the top ends of the rollers 48 and the bottom surface of the first stage 6.

When the microwave oven is used in this state, for example, by performing high-frequency heating and grill heating simultaneously, as the motor 5 is driven, the antenna 4 rotates, and thus the rollers 48 roll on the bottom surface of the stage 6. This prevents the peripheral portion of the radiator portion 42 from being bent upward in the axial direction by the magnetic attraction, and thus keeps the radiator portion 42 and the stage 6 parallel.

Figure 17:
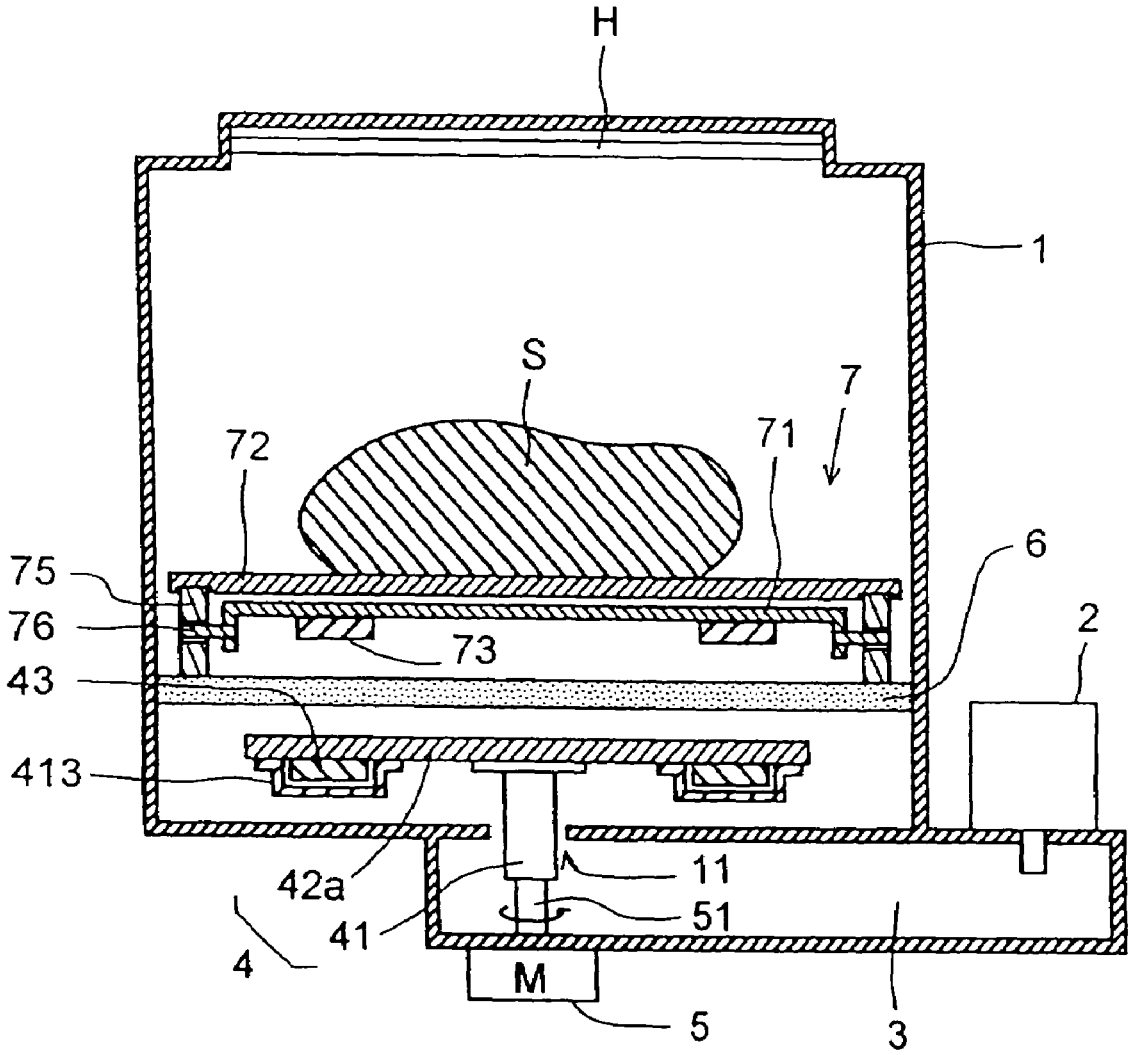
FIG. 17 is a front sectional view showing another example of a microwave oven according to the invention.
Figure 18:
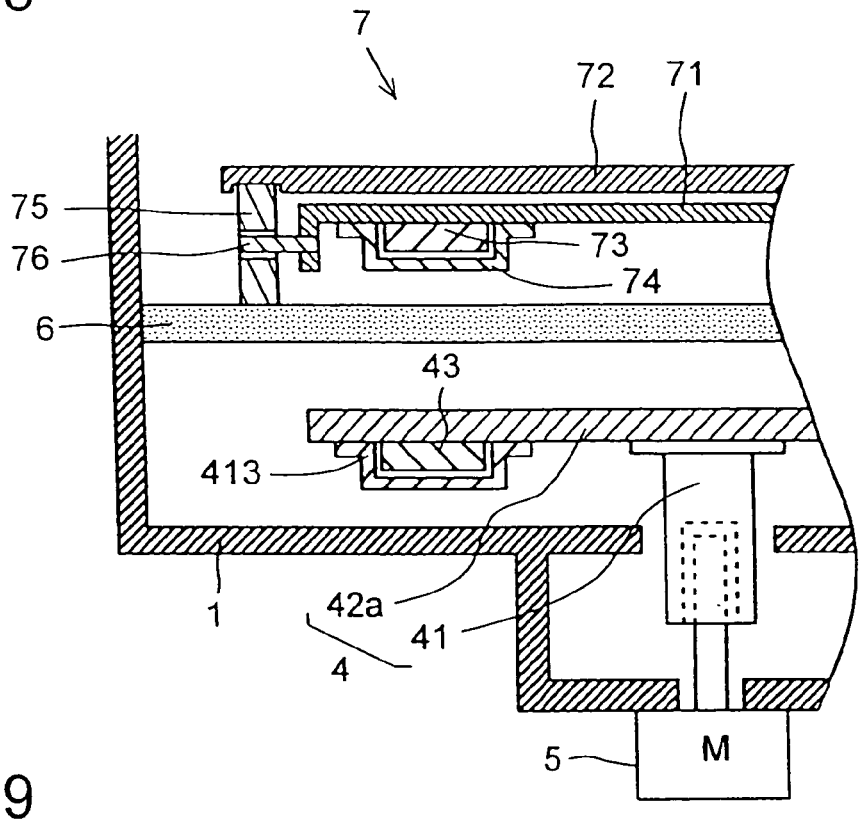
FIG. 18 is a partial sectional view of the microwave oven of FIG. 15.

As still another example of a microwave oven according to the invention, the following construction is possible. In a case where the heating compartment 1 is made of a magnetic material, to allow the antenna 4 to rotate smoothly, no magnetic attraction needs to be permitted to appear between the first magnets 43 and the floor of the heating compartment 1; simultaneously, to allow the rotary stage 7 to rotate smoothly as the antenna 4 rotates, the magnetic attraction between the first magnets 43 and the second magnets 73 needs to be maintained. This is achieved by covering the side of the first magnets 43 facing the stage with a nonmagnetic member, and covering the side of the first magnets 43 facing the floor of the heating compartment 1 with a magnetic member. FIGS. 17 and 18 are respectively a front sectional view and a partial sectional view showing an example of such a microwave oven. It should be noted that, in the following description, no explanations will be repeated of such components and structures as are found also in the microwave oven of FIG. 1, and chiefly differences therefrom will be discussed.

In the microwave oven of FIG. 17, what is located adjacently above the first magnets 43 fitted on the bottom surface of the radiator portion 42*a* is the radiator portion 42*a* of the antenna, which is made of alumina (a nonmagnetic material). This ensures magnetic coupling between the first magnets 43 and the second magnets 73. On the other hand, the first magnets 43 are covered with a magnetic member 413 from below. This permits no magnetic attraction to appear between the floor of the heating compartment 1, which is made of a magnetic material, and the first magnets 43, allowing the radiator portion 42*a* of the antenna 4 to rotate smoothly. Accordingly, as the antenna 4 rotates, the rotary stage 7 rotates at the same speed as the antenna 4, and the table 72 supported on the rollers 75 rotates at twice the rotation speed of the antenna 4. Thus, the heating target S placed on the table 72 is heated uniformly with the high-frequency wave radiated from the radiator portion 42*a* and with the heat from the heater H.

Here, by forming the radiator portion 42*a*, which is a non-magnetic member, and the magnetic member 413 both as metal members, it is possible to reduce the effect of the high-frequency wave on the first magnets 43.

Figure 19:
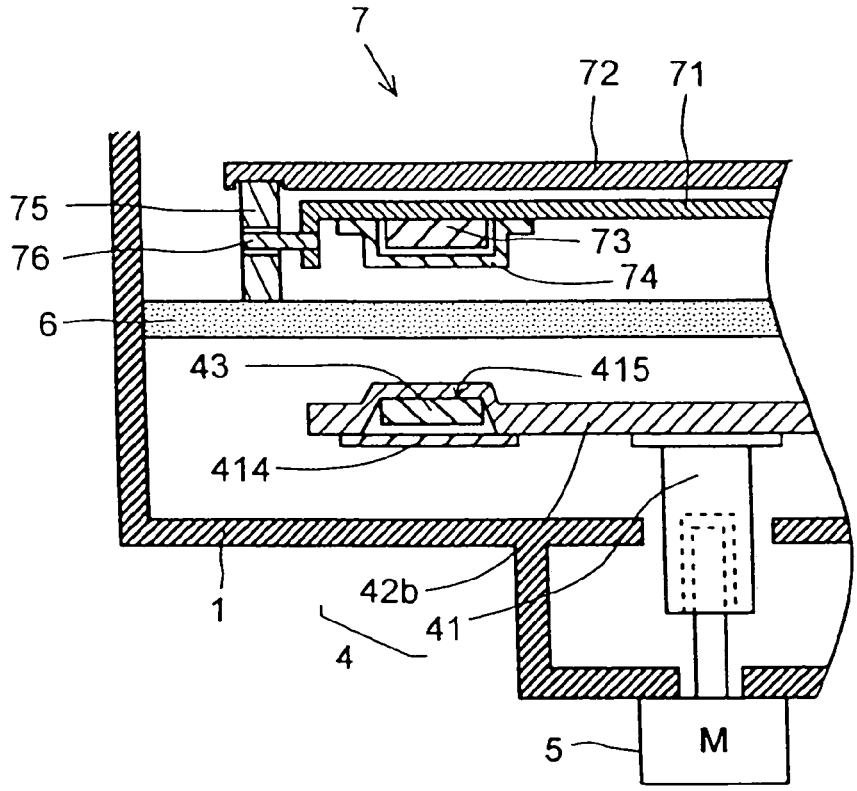
FIG. 19 is a partial sectional view showing another implementation of a microwave oven according to the invention.

FIG. 19 shows another example of the antenna 4. In the antenna 4 of FIG. 19, in the bottom surface of the radiator portion 42*b*, depressions 415 of which the depth is greater than the thickness of the first magnets 43 are formed at equal angular intervals in the circumferential direction, and the first magnets 43 are fitted there. The openings of the depressions 415 are closed with magnetic members 414 to form flat plates. With this construction, when the first magnets 43 are fitted, they can be easily positioned; moreover, the magnetic members 414 can be easily formed; and, moreover, the apparatus can be made thin.

Figure 20:
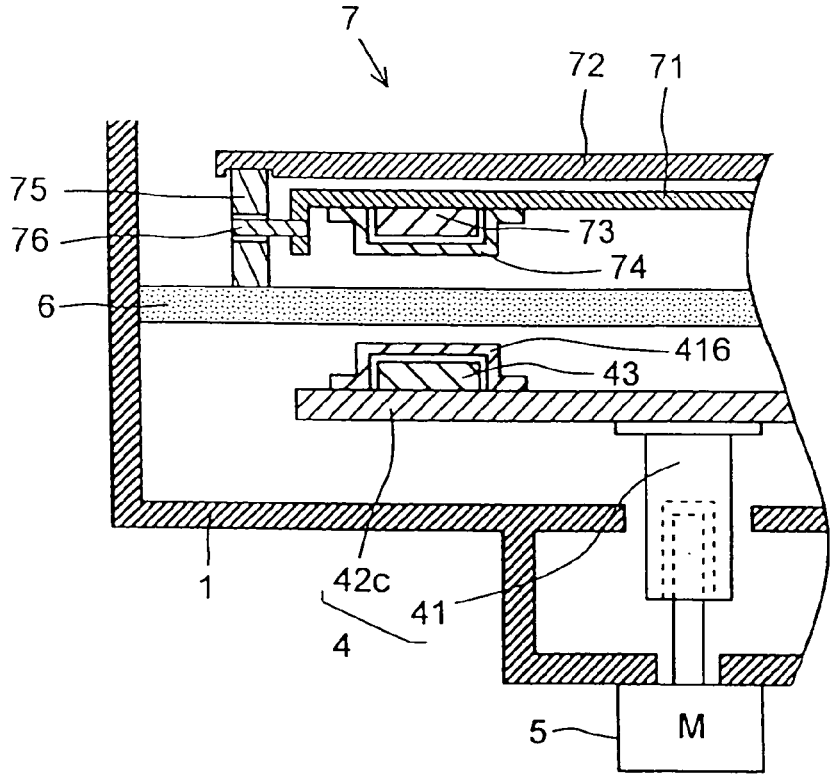
FIG. 20 is a partial sectional view showing another implementation of a microwave oven according to the invention.

FIG. 20 is a partial sectional view showing another example of a microwave oven according to the invention. In the microwave oven of FIG. 20, on the top surface of the radiator portion 42*c*, which is made of a magnetic material, the first magnets 43 are fitted at equal angular intervals in the circumferential direction, and their surfaces are covered with nonmagnetic members 416. With this construction, as with the previously described construction, no magnetic attraction appears between the floor of the heating compartment 1 and the first magnets 43, permitting the radiator portion 42*c* of the antenna 4 to rotate smoothly. On the other hand, what are located adjacently above the first magnets 43 are the nonmagnetic members 416, ensuring magnetic coupling between the first magnets 43 and the second magnets 73.

Figure 21:
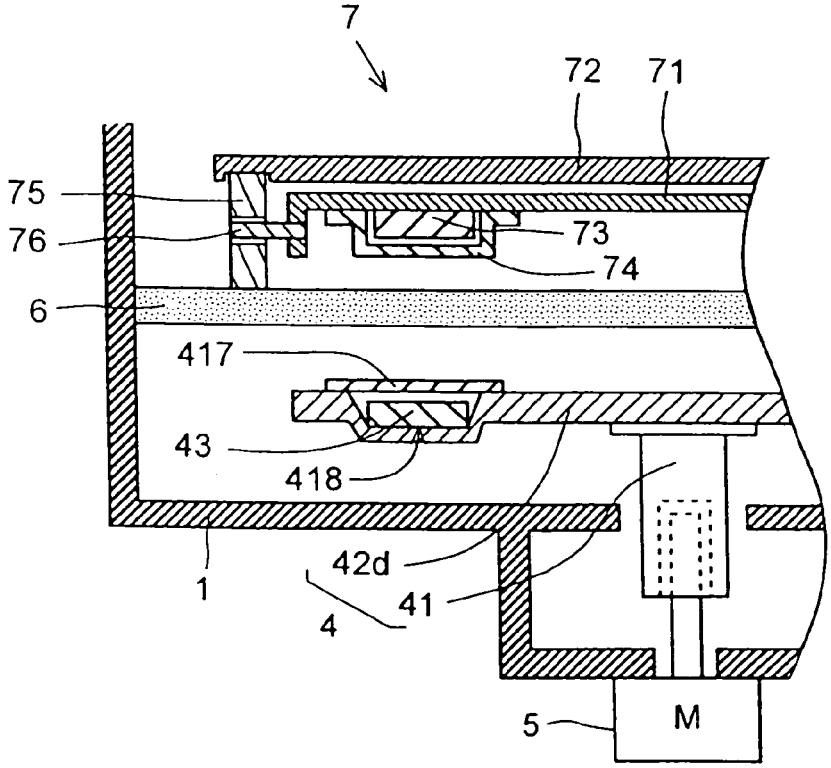
FIG. 21 is a partial sectional view showing another implementation of a microwave oven according to the invention.

FIG. 21 shows another example of the antenna 4. In the antenna 4 of FIG. 21, in the top surface of the radiator portion 42*d*, depressions 418 of which the depth is greater than the thickness of the first magnets 43 are formed at equal angular intervals in the circumferential direction, and the first magnets 43 are fitted there. The openings of the depressions 418 are closed with nonmagnetic members 417 to form flat plates. With this construction, as with the previously described construction, when the first magnets 43 are fitted, they can be easily positioned; moreover, the nonmagnetic members 417 can be easily formed; and, moreover, the apparatus can be made short.

Figure 22:
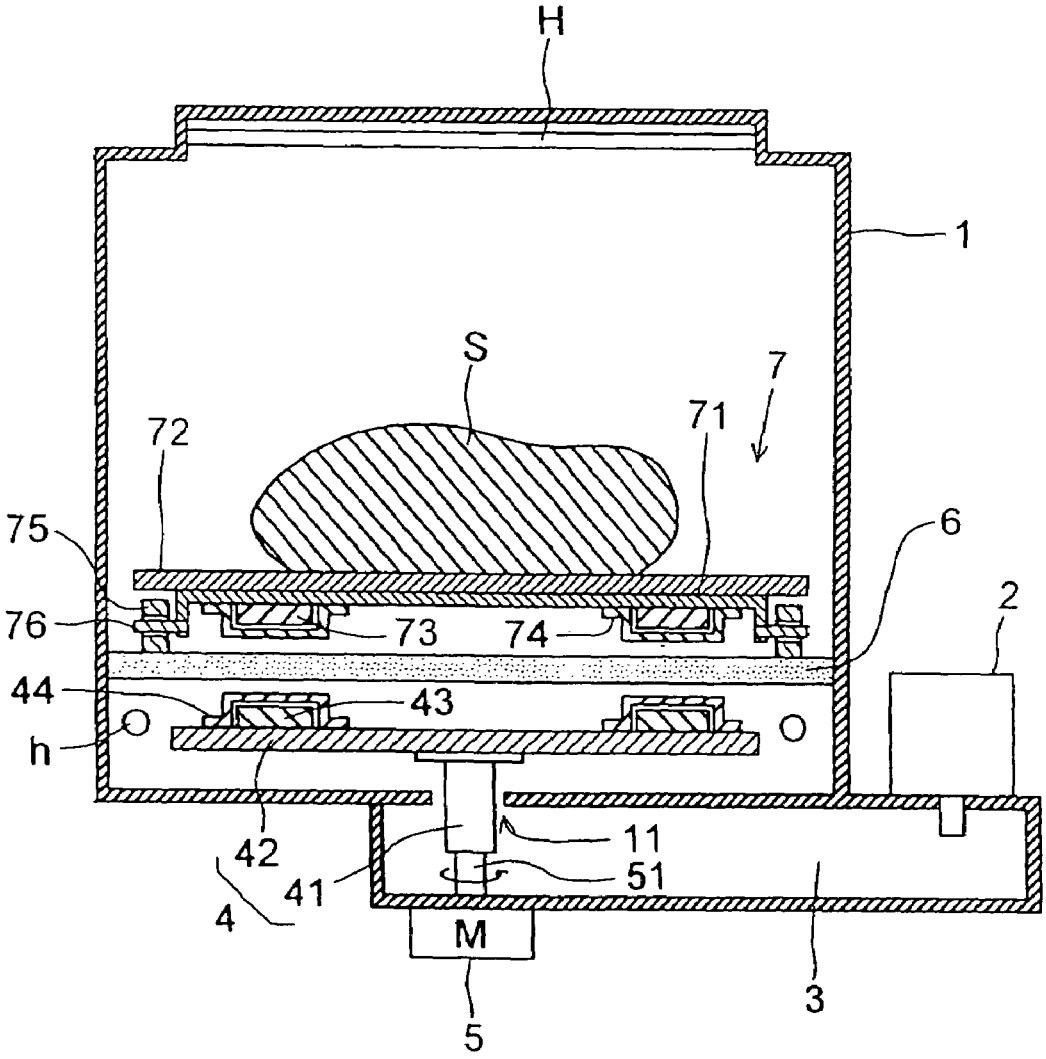
FIG. 22 is a vertical sectional view, when the rotary member is used in a microwave oven provided with a lower heater.
Figure 23:
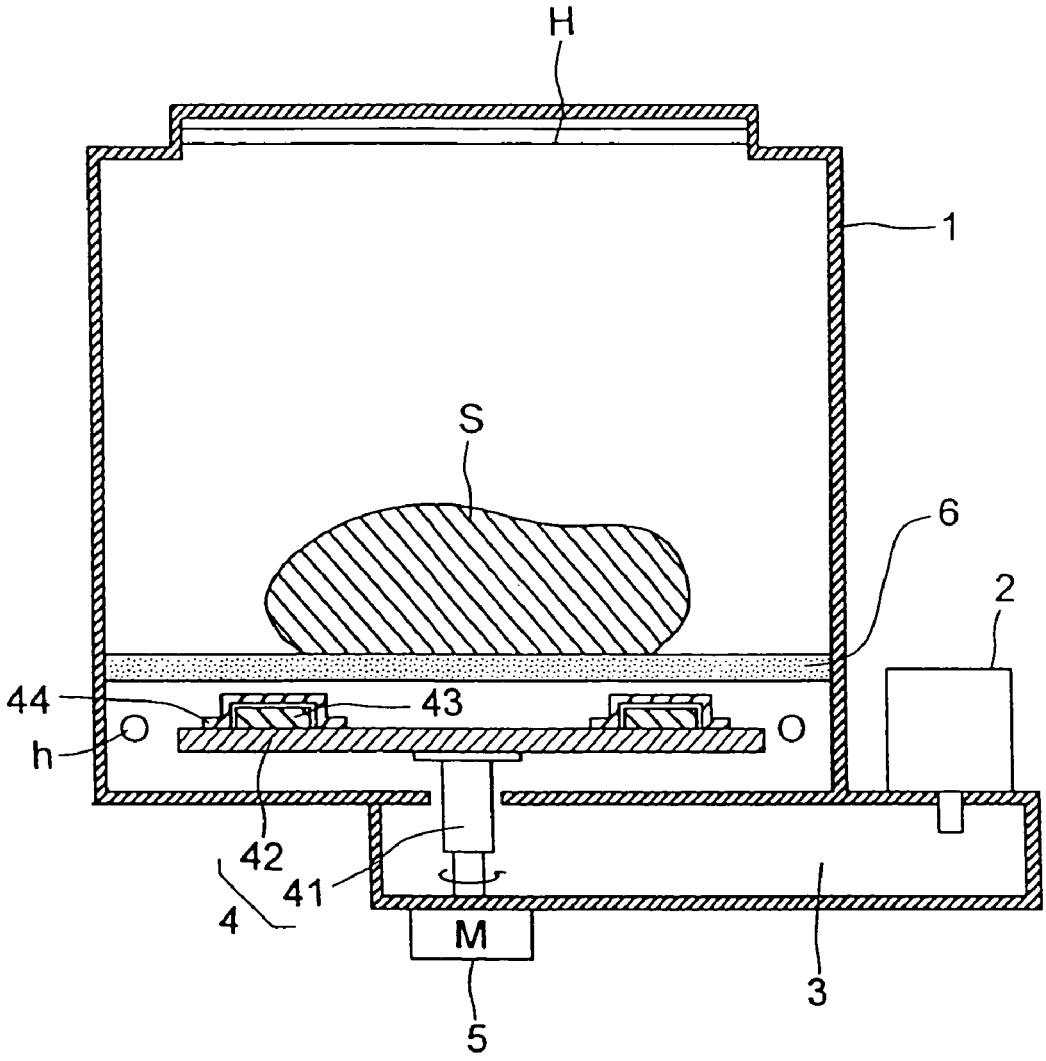
FIG. 23 is a vertical sectional view, when the rotary member is not used in a microwave oven provided with a lower heater.
Figure 24:
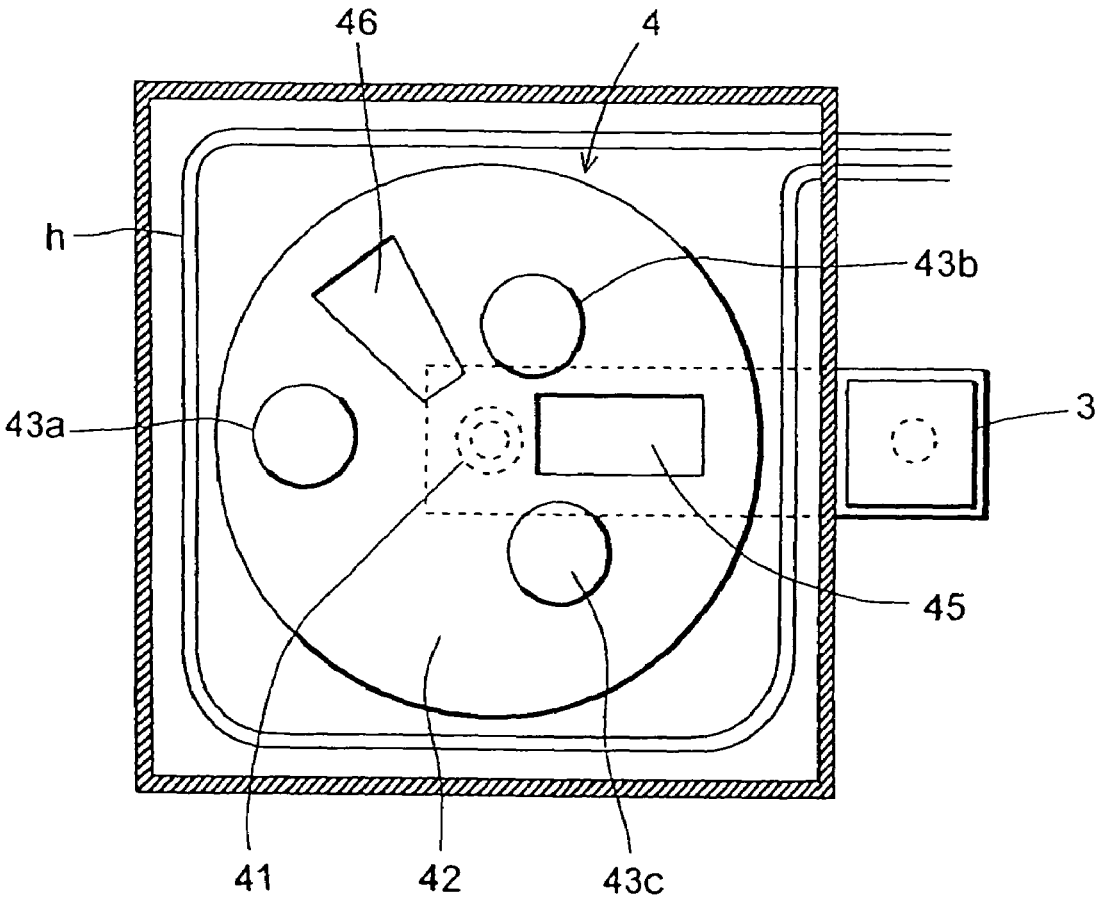
FIG. 24 is a horizontal sectional view of the microwave oven of FIG. 22.

Another example of a microwave oven according to the invention will be described below. FIG. 22 is a vertical sectional view thereof as seen from the front, and FIG. 23 is a vertical sectional view thereof as seen from the front when the rotary stage is not used. An outstanding feature of this microwave oven is that a lower heater h built with a sheath heater as shown in FIG. 24 is arranged around the periphery of the antenna 4. This makes it possible to add a grill heating function or the like. It should be noted that, in the following description, no explanations will be repeated of such components and structures as are found also in the microwave oven of FIG. 1, and chiefly differences therefrom will be discussed.

When high-frequency heating is performed by using the antenna as ordinarily performed, as shown in FIG. 23, the rotary stage 7 is removed, and high-frequency heating is performed with the heating target S placed directly on the stage 6. In this way, the space inside the heating compartment 1 can be efficiently used, and the advantages that the antenna-feed-type construction has conventionally had are maintained.

When the heating target S needs to be rotated, as shown in FIG. 22, the heating target S is placed on the substantially circular table 72 of the rotary stage 7. The rotation of the antenna 4 is transmitted to the rotary stage 7 by the magnetic coupling between the first magnets 43 and the second magnets 73 described above, making the rotary stage 7 rotate.

When the heating target S needs to be browned, it is heated with the lower heater h operated. In this case, to prevent the first magnets 43 fitted to the antenna 4 from being intensively heated by the lower heater h, the antenna 4 is rotated. Accordingly, thanks to the magnetic coupling between the first magnets 43 and the second magnets 73, the rotary stage 7 rotates together.

Now, why the antenna 4 is rotated when the lower heater h is operated so as to prevent the first magnets 43 from being intensively heated will be described with reference to FIG.

Figure 25:
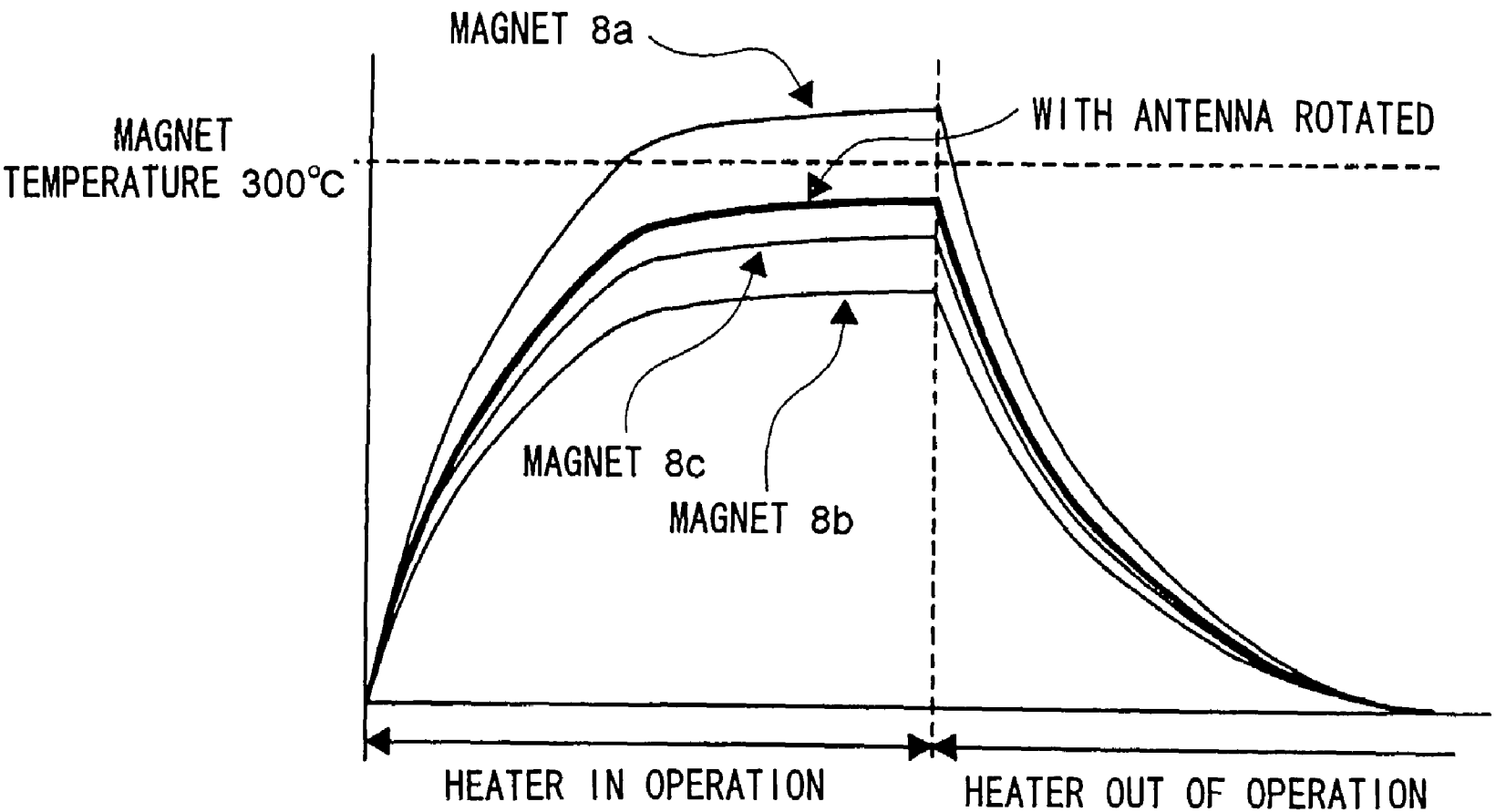
FIG. 25 is a diagram showing an example of the temperature variation characteristics of the magnets provided on the antenna in a microwave oven according to the invention.

25. FIG. 25 shows the time-related temperature variation characteristics of the individual magnets as observed when the lower heater h is operated with or without the antenna 4 rotated. Here, the stop position is arbitrary, and therefore the plotted characteristics should be understood to be a mere example.

When the lower heater h is operated with the antenna 4 stopped, the temperature of the first magnets 43*a*, 43*b*, and 43*c* rises as they are heated by the lower heater h. Since the magnet 43*a* is the closest to the lower heater h, its temperature rises at a higher rate than that of the magnets 43*b* and 43*c*. In general, magnets undergo irreversible demagnetization at high temperatures. Thus, it is important to limit the rise in the temperature of the magnets. For this reason, in order to prevent magnets from being overheated because of local heat concentration at particular locations, the antennae 4 in this embodiment is rotated continuously when lower heater h is in operation. In this way, it is possible to level out the rises in the temperature of a plurality of magnets.

Figure 26:
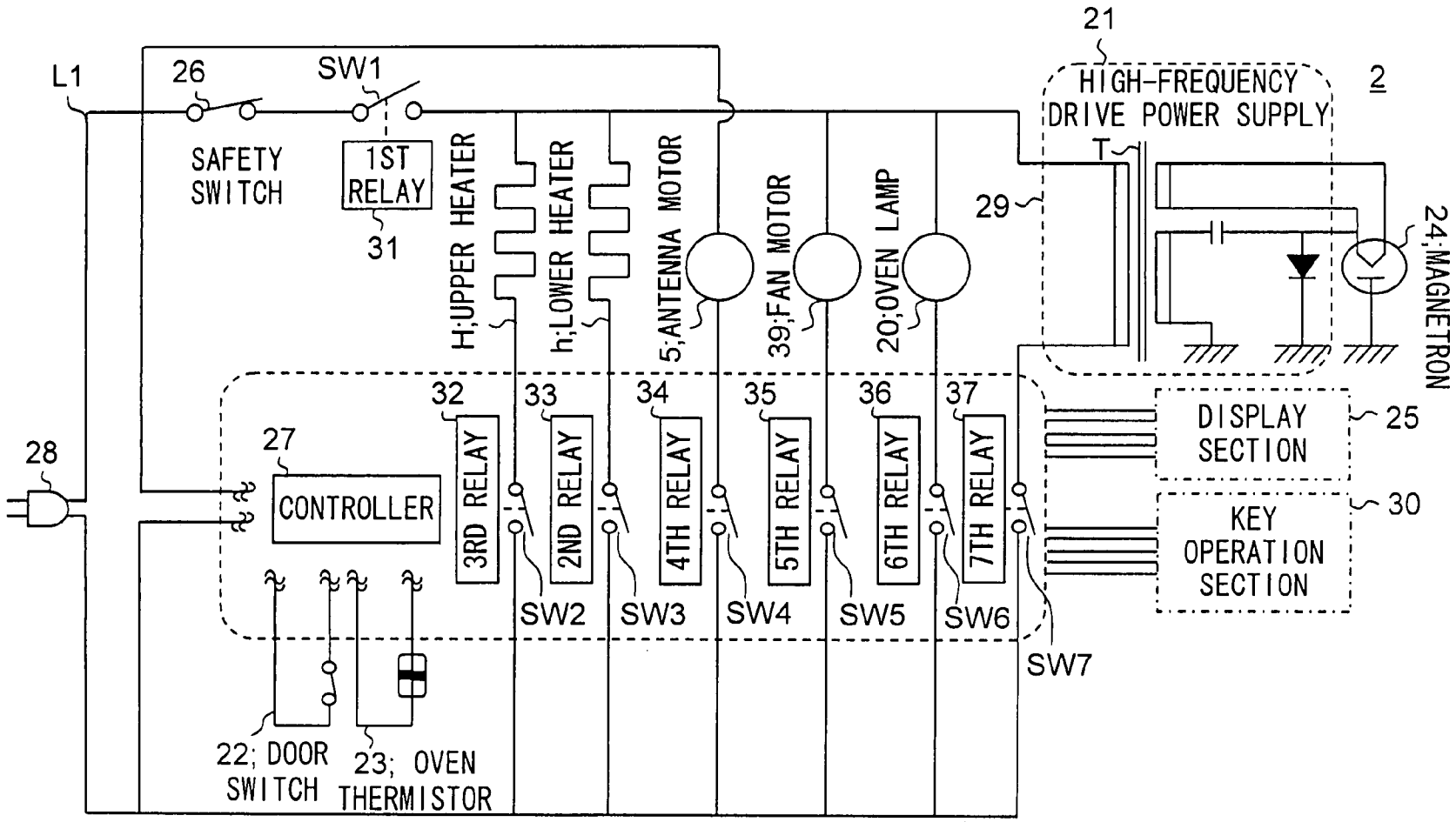
FIG. 26 is a control block diagram in a microwave oven according to the invention.

FIG. 26 shows an example of the drive circuit of the microwave oven of this embodiment. This drive circuit is so configured as to operate, for high-frequency heating, the magnetron 2 and the antenna 4 and, for heater heating, operate the upper and lower heaters H and h and the antenna 4 while keeping the magnetron 2 out of operation.

As shown in FIG. 26, to the output line L1 of a plug 28 for receiving commercially distributed alternating-current power, there are serially connected the following components in the order mentioned: the first relay switch SW1 that is opened and closed by a safety switch 26 and the first relay 31; the primary coil 29 of a high-frequency drive power supply transformer T; and the seventh relay switch SW7 that is opened and closed by the seventh relay 37. Parallel with the primary coil 29 of the transformer T and the seventh relay switch SW7, there are connected several relay switches along with the loads driven by those relay switches.

Specifically, these pairs of relays and loads include: the second relay switch SW2 that is opened and closed by the second relay 32, along with the upper heater H; the third relay switch SW3 that is opened and closed by the third relay 33, along with the lower heater h; the fourth relay switch SW4 that is opened and closed by the fourth relay 34, along with the antenna motor 5 for driving the antenna 4; the fifth relay switch SW5 that is opened and closed by the fifth relay 35, along with a fan motor 39 for cooling the high-frequency drive power supply 21; and the sixth relay switch SW6 that is opened and closed by the sixth relay 36, along with an oven lamp 20 for illuminating the interior of the heating compartment.

The first to seventh relays 31 to 37 are driven and controlled by a controller 27, but the control lines from the controller to each relay are not shown here. The controller 27 is connected also to a door switch 22 and an oven thermistor 23 so as to receive information also from the door switch 22 and the oven thermistor 23.

The controller 27 is connected also to a display section 25 and to a key operation section 30 so as to control the display section 25 and to receive information from the key operation section 30, respectively. Reference numeral 24 represents a magnetron.

Next, the operation will be described. First, from the key operation section 30, information on the type of heating, i.e. whether to perform high-frequency heating or heater heating using the upper and lower heaters is entered, and conditions such as the heating duration are specified. Then, a command is entered to start heating. For high-frequency heating, the first, fourth, fifth, sixth, and seventh relay switches SW1, SW4, SW5, SW6, and SW7 are turned on. As the result of the first and seventh relay switches SW1 and SW7 being turned on, a current flows through the primary coil 29 of the high-frequency drive power supply transformer T, and the high-frequency drive power supply 21 starts operating. This turns the magnetron 24 on, causing it to generate a high-frequency electromagnetic wave. As the result of the fourth relay switch SW4 being turned on, the motor 5 starts operating, causing the antenna 4 to rotate. As the result of the fifth and sixth relay switches SW5 and SW6 being turned on, the fan motor 39 for cooling the high-frequency drive power supply 21 starts operating, and the oven lamp 20 for illuminating the interior of the heating compartment is lit. In this case, the second and third relay switches SW2 and SW3 are kept off, and thus the upper and lower heaters H and h are kept out of operation.

On the other hand, for heater heating, in addition to the first, fourth, and sixth relay switches SW1, SW4, and SW6, the second and third relay switches SW2 and SW3 are turned on so that heating is performed with the upper and lower heaters H and h. In this case, the fourth relay switch SW4 is on, in order to rotate the antenna 4.

Thus, as described earlier, the first magnets 43 fitted on the antenna 4 are not locally overheated by the lower heater h. This prevents demagnetization of the first magnets 43. Here, the seventh relay switch SW7 is kept off so that no current flows through the primary coil 29 of the high-frequency drive transformer T. Thus, the high-frequency drive power supply 21 is kept out of operation, keeping the magnetron 24 out of operation.

Figure 27:
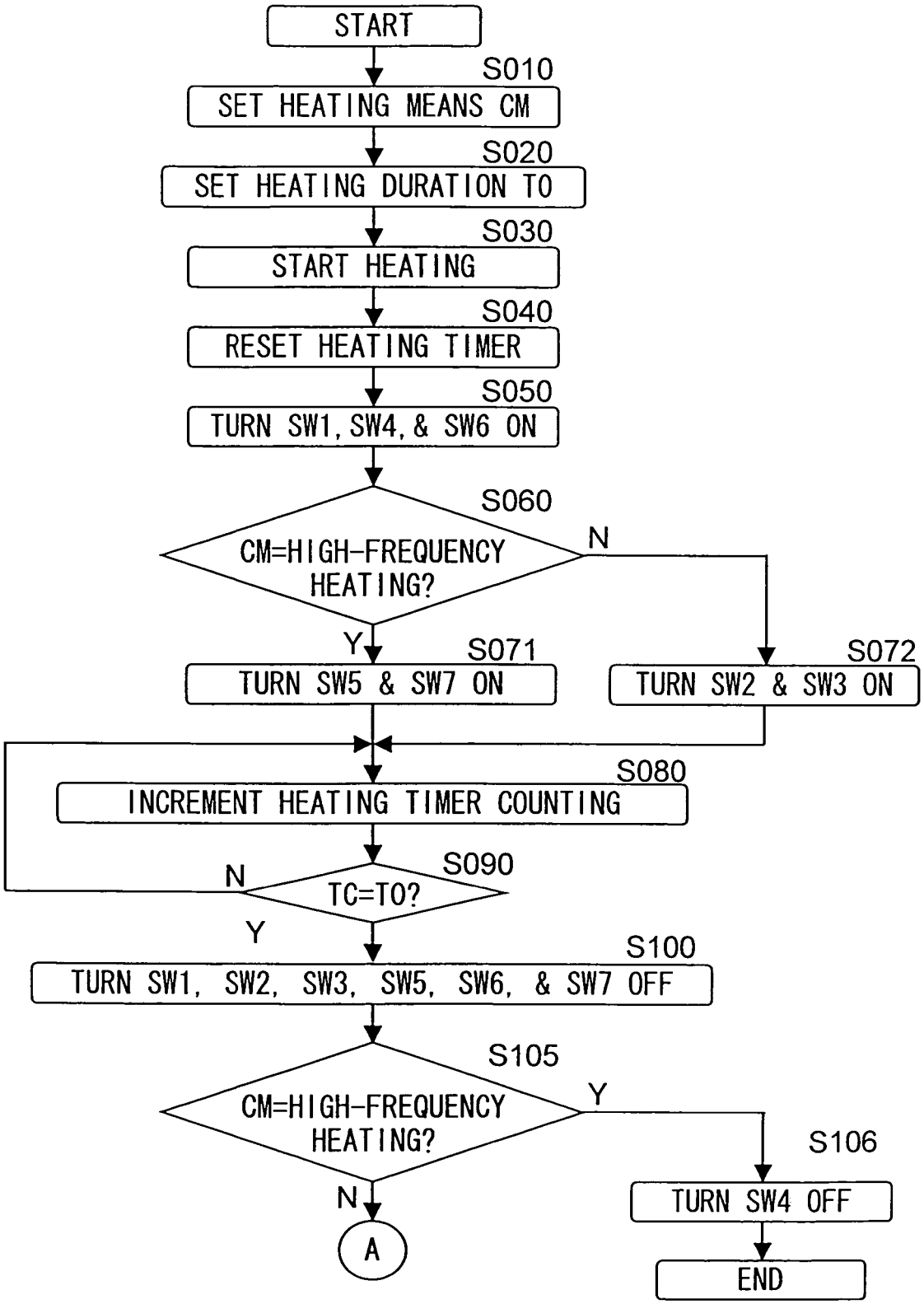
FIG. 27 is a flow chart during heating as used by the control block according to the invention.

Next, the control flow of operations performed by the controller 27 will be described with reference to the flow charts shown in FIGS. 27 to 30. First, the flow of operations for heating will be described with reference to FIG. 27. As shown in FIG. 27, first, in step S010, according to the information entered via the key operation section 30, the controller 27 sets, as heating means, either heater heating or high-frequency heating. Next, in step S020, the heating duration T0 is set. Thereafter, in step S030, heating is started. When heating is started here, in step S040, a heating timer is reset. This heating timer is included in the controller 27. Next, in step S050, the first relay switch SW1 is turned on so that the individual loads are connected to the output line L1 of the plug 28 for receiving commercially distributed alternating-current power, the fourth relay switch SW4 is turned on to rotate the antenna 4, and the sixth relay switch SW6 is turned on to light the oven lamp 20 for illuminating the interior of the heating compartment. Next, in step 060, whether or not the heating means that was set in step S010 is high-frequency heating is checked. If high-frequency heating is found to have been set, then, in step S071, the fifth relay switch SW5 is turned on to drive the fan motor 39 for cooling the high-frequency drive power supply 21, and the relay switch SW7 is turned on to pass a current through the primary coil 29 of the high-frequency drive transformer T to operate the high-frequency drive power supply 21 and make it generate a high-frequency electromagnetic wave. If high-frequency heating is found not to have been set, then, in step S072, the second and third relay switches SW2 and SW3 are turned on to drive the upper and lower heaters H and h.

Next, in step S080, the heating timer is started to count time, and then, in step S090, whether or not its count TC has reached the predetermined value T0 that was set in step S020 is checked. If TC has reached the set value, the flow returns to step S080; if TC has not reached the set value, the flow proceeds to step S100, where the first, second, third, fifth, sixth, and seventh relay switches SW1, SW2, SW3, SW5, SW6, and SW7 are turned off so that the loads other than the antenna 4 are stopped to end the heating. Next, in step S105, whether or not the heating means is high-frequency heating is checked so that, if it is found to be high-frequency heating, then, in step S106, the fourth relay switch SW4 is turned off to stop the rotation of the antenna 4, finishing the flow of operations for heating.

Different embodiments are possible for the flow control after the heating means is found not to be high-frequency heating in step S105. In one embodiment, as shown in the flow chart of FIG. 28, the rotation of the antenna 4 after heating is controlled by the use of a timer. In another embodiment, as shown in the flow chart of FIG. 29, the rotation of the antenna 4 after heating is controlled by the use of a temperature detector. In still another embodiment, as shown in the flow chart of FIG. 30, the rotation of the antenna 4 after heating is controlled by the use of a timer, and in addition the rotation of the antenna 4 is controlled differently between when the rotary stage 7 is used (i.e. when the heating target S is heated with the heating target S placed on the table 72 on the rotary stage 7 that is rotated by the magnetic coupling between the first magnets 43 arranged on the antenna 4 and the second magnets 73 arranged on the rotary stage 7) and when the rotary stage 7 is not used (i.e. when the heating target S is heated with the heating target S placed directly on the stage 6). Now, each of these embodiments will be described one by one with reference to the flow charts of FIGS. 28, 29, and 30.

Figure 28:
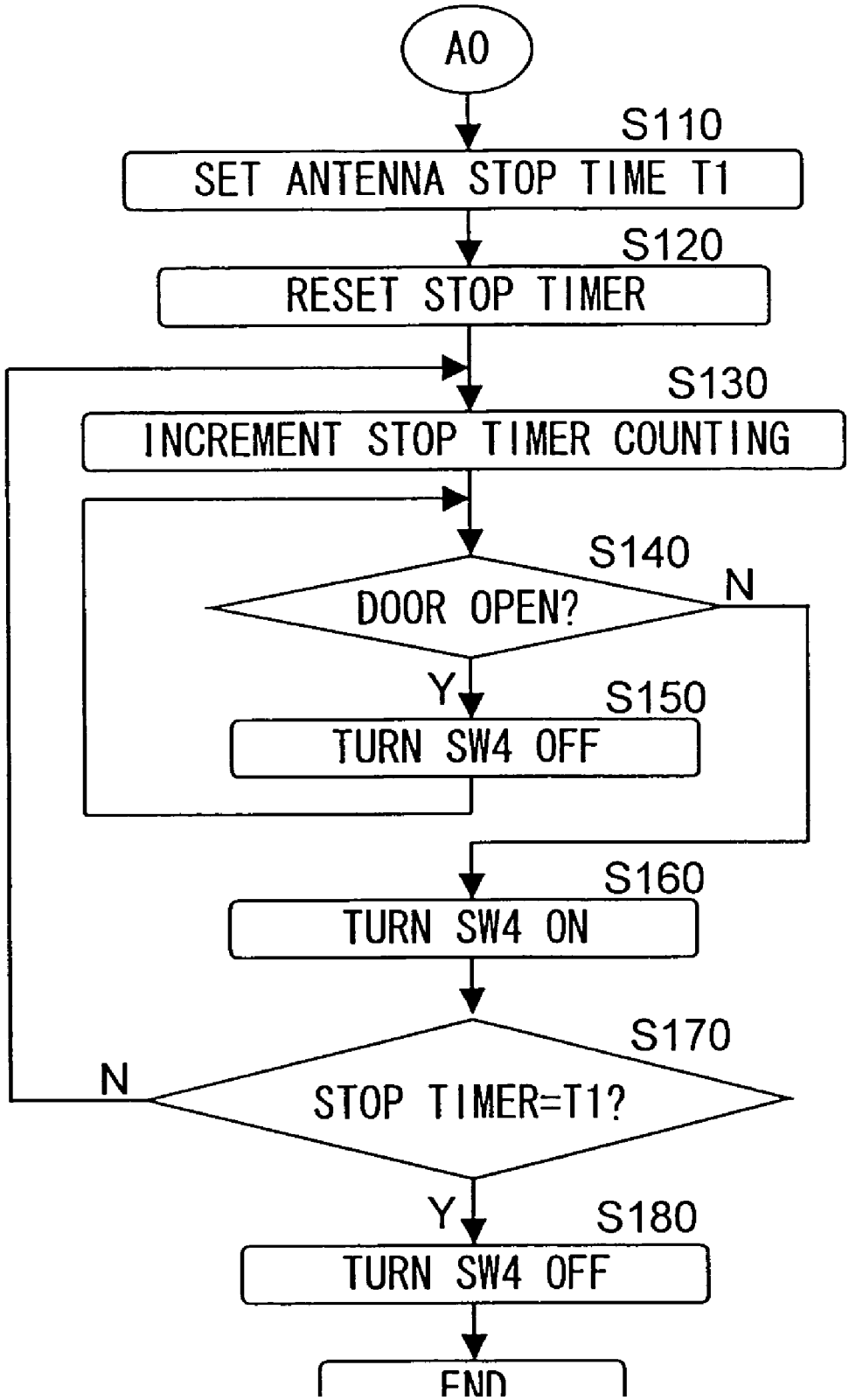
FIG. 28 is a flow chart after heating as used, in a first embodiment, by the control block according to the invention.
Figure 31:
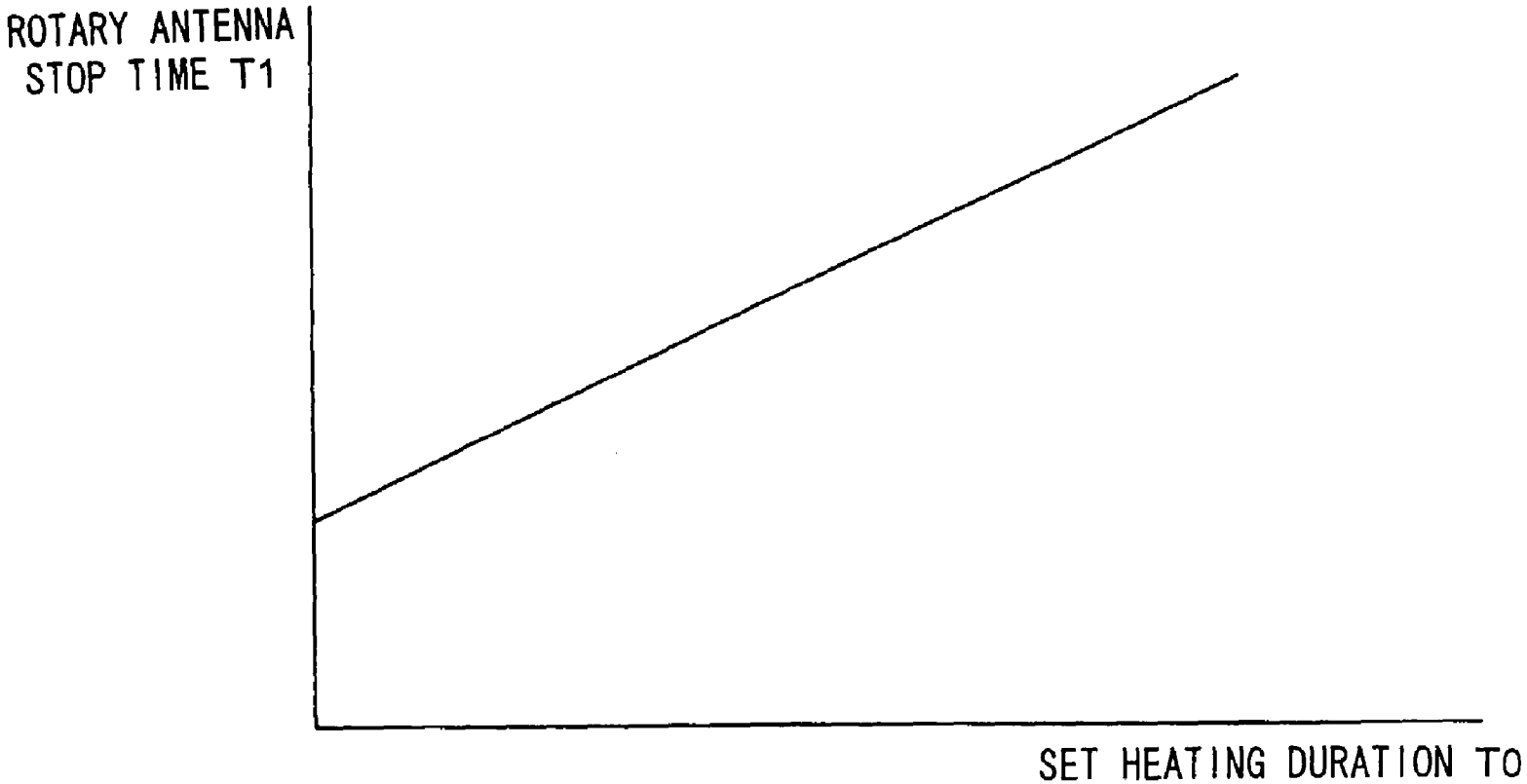
FIG. 31 is a diagram showing an example of the relationship between the specified heating duration and the duration for which the rotary antenna is stopped as used by the control block according to the invention.
Figure 32:
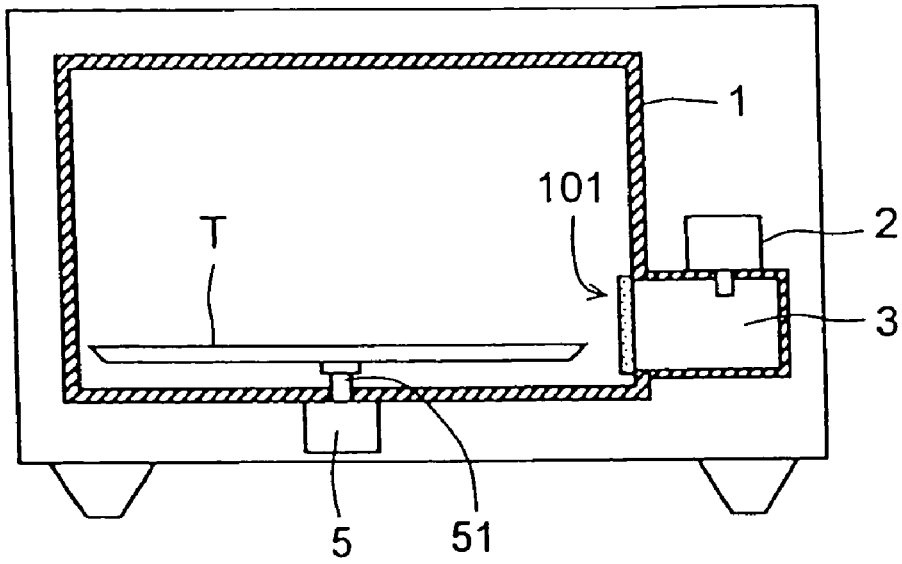
FIG. 32 is a front sectional view showing a conventional turntable-type high-frequency heating apparatus.
Figure 33:
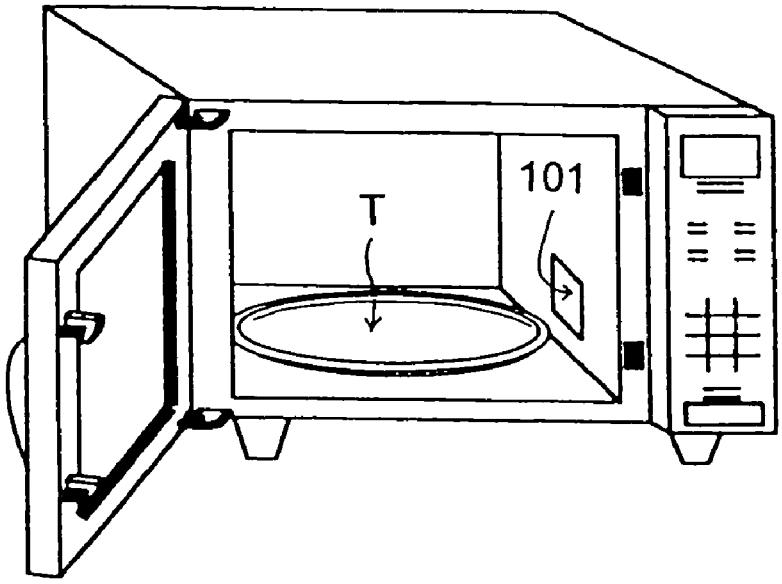
FIG. 33 is a perspective view showing a conventional turntable-type high-frequency heating apparatus.
Figure 34:
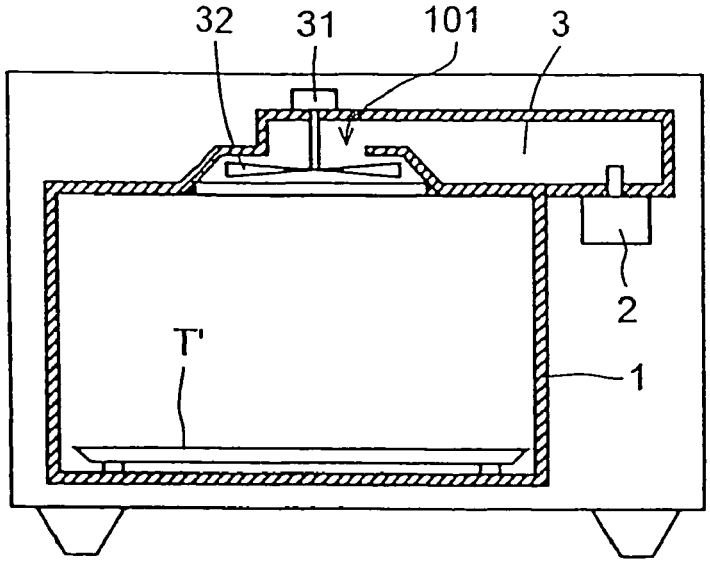
FIG. 34 is a front sectional view showing a conventional stirrer-type high-frequency heating apparatus.
Figure 35:
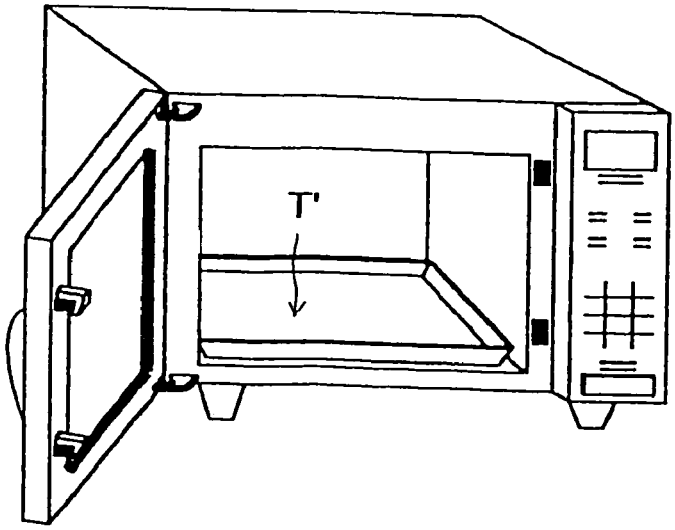
FIG. 35 is a perspective view showing a conventional stirrer-type high-frequency heating apparatus.
Figure 36:
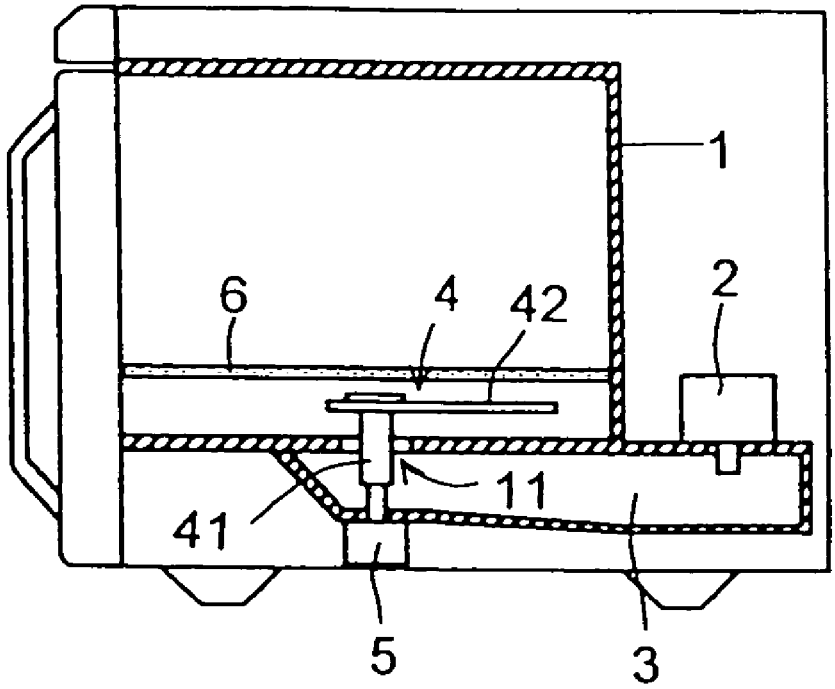
FIG. 36 is a side sectional view showing a conventional antenna-type high-frequency heating apparatus.
Figure 37:
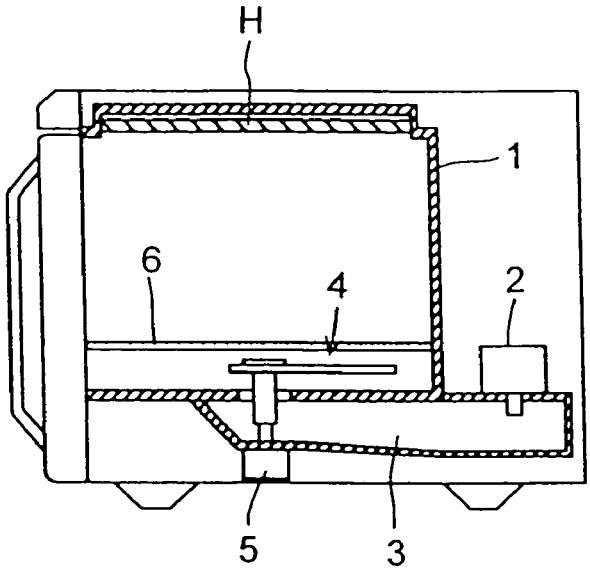
FIG. 37 is a front sectional view showing a conventional high-frequency heating apparatus provided with a stirring function.
Figure 38:
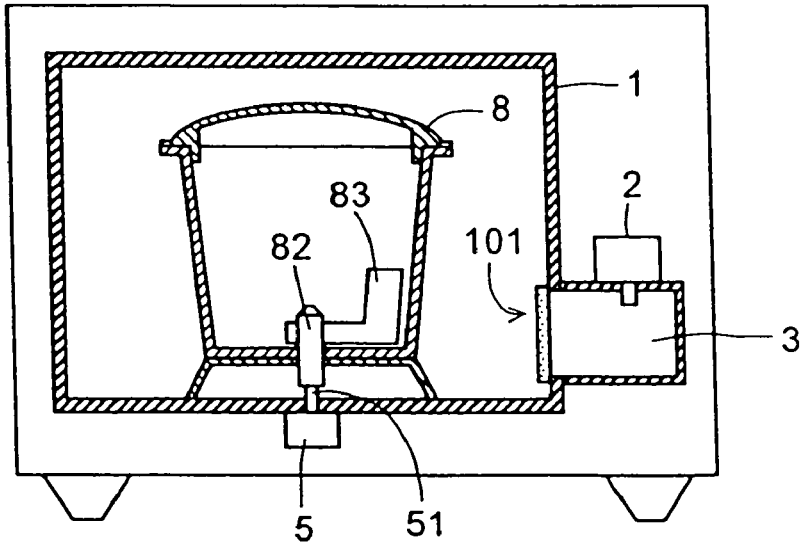
FIG. 38 is a side sectional view showing a conventional antenna-type high-frequency heating apparatus provided with a heater.

First, the first embodiment will be described with reference to FIG. 28. If, in step S105 in FIG. 27, the heating means is found not to be high-frequency heating (i.e., if it is found to be heater heating), then the flow proceeds to step S110 in FIG. 28. In this step, the antenna stop time T1, which has thus far been rotating, is set. Next, in step S120, a stop timer is reset, and then, in step S130, the stop timer is started to count time. The antenna stop time T1 may be a fixed duration that is determined in advance, or may be a function of the set heating duration T0 or of the actual heating duration and the actual operation duration of the lower heater. By setting the antenna stop time T1 to be a function of the set heating duration T0 or the like, it is possible, when the set heating duration T0 is short, to shorten the antenna stop time T1 accordingly. This helps eliminate unnecessary power consumption. FIG. 31 shows an example where the stop time T1 is set to be a function of the set heating duration T0.

Next, in step S140, whether or not the door is open is checked. If the door is found to be open, then, irrespective of whether or not the timer has counted to the end, in step S150, the fourth relay switch SW4 is turned off to stop the rotation of the antenna 4. Then, the flow returns to step S140, where whether or not the door 15 is open is checked again. So long as the door 15 is found to be open, the operations in steps S140 and S150 are repeated. Thereafter, when the door 15 is found not to be open, the flow proceeds to step S160, where the fourth relay switch SW4 is turned on to rotate the antenna 4.

Next, in step S170, whether or not the count of the stop timer has reached the predetermined value T1 that was set in step S110 described above is checked. If the count is found to have reached the predetermined value T1, then the flow proceeds to step S180, where the fourth relay switch SW4 is turned off to stop the rotation of the antenna 4, finishing the flow after heating. If the count is found not to have reached that value, the flow returns to step S130 to repeat the operations in steps S130 to S170.

Figure 29:
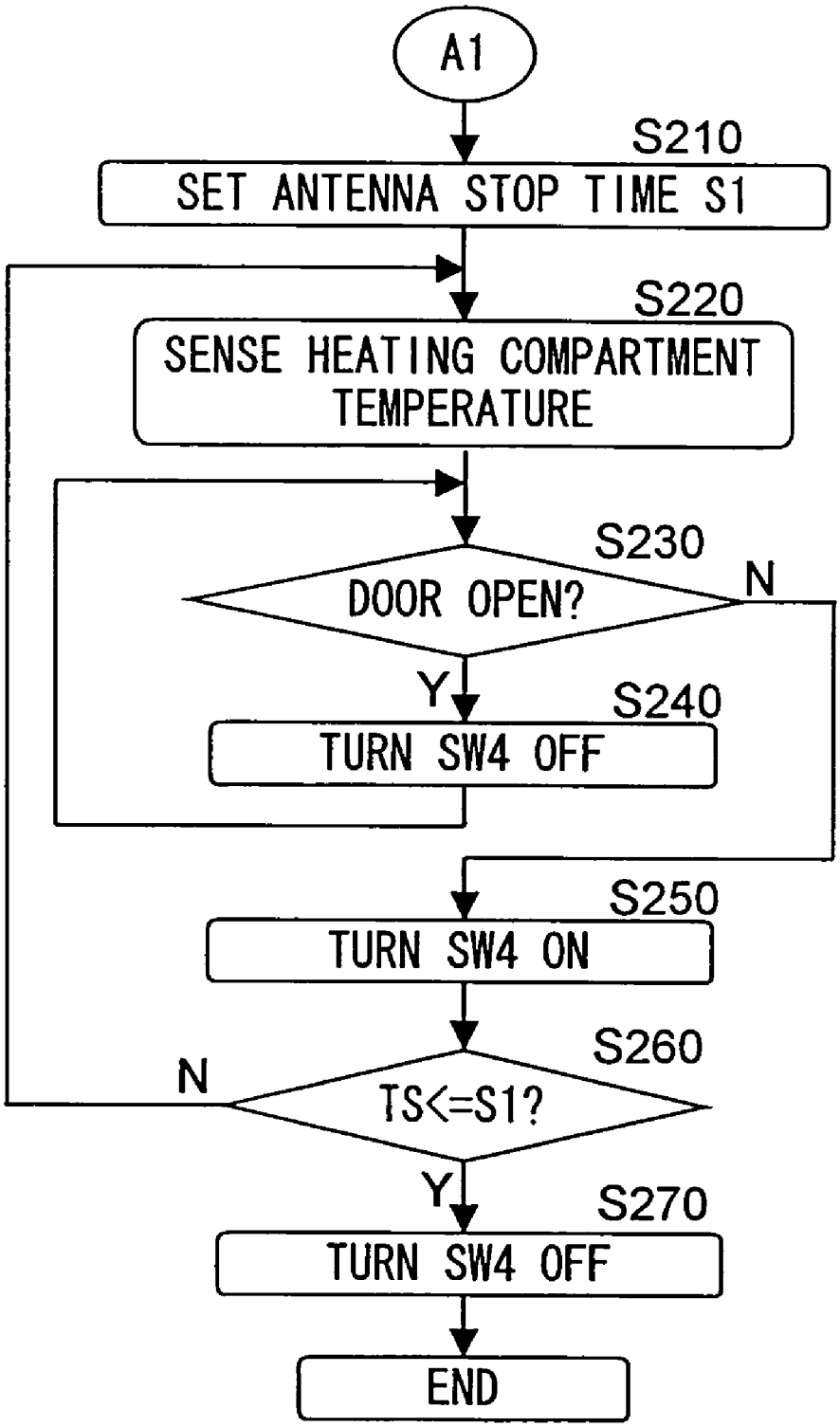
FIG. 29 is a flow chart after heating as used, in a second embodiment, by the control block according to the invention.

Next, the second embodiment will be described with reference to FIG. 29. If, in step S105 in FIG. 27 described earlier, the heating means is found not to be high-frequency heating (i.e., if it is found to be heater heating), then the flow proceeds to step S210 in FIG. 29. In this step, the antenna stop temperature S1 is set. Next, in step S220, the heating compartment temperature TS is sensed, and then the flow proceeds to step S230. In this step, whether or not the door is open is checked. If the door is found to be open, then, in step S240, the fourth relay switch SW4 is turned off to stop the rotation of the antenna 4. Then, the flow returns to step S230, where whether or not the door is open is checked again. So long as the door is found to be open, the operations in steps S230 and S240 are repeated. Thereafter, when the door 15 is found not to be open, the flow proceeds to step S250, where the fourth relay switch SW4 is turned on to rotate the antenna 4.

Next, in step S260, whether or not the heating compartment temperature TS is equal to or lower than the predetermined value S1 that was set in step S210 described above is checked. If the temperature TS is lower than the predetermined value S1, then the flow proceeds to step S270, where the fourth relay switch SW4 is turned off to stop the rotation of the antenna 4, finishing the flow after heating. If the temperature TS has not reached the predetermined value S1, the flow returns to step S220 to repeat the operations in steps S220 through S260.

Figure 30:
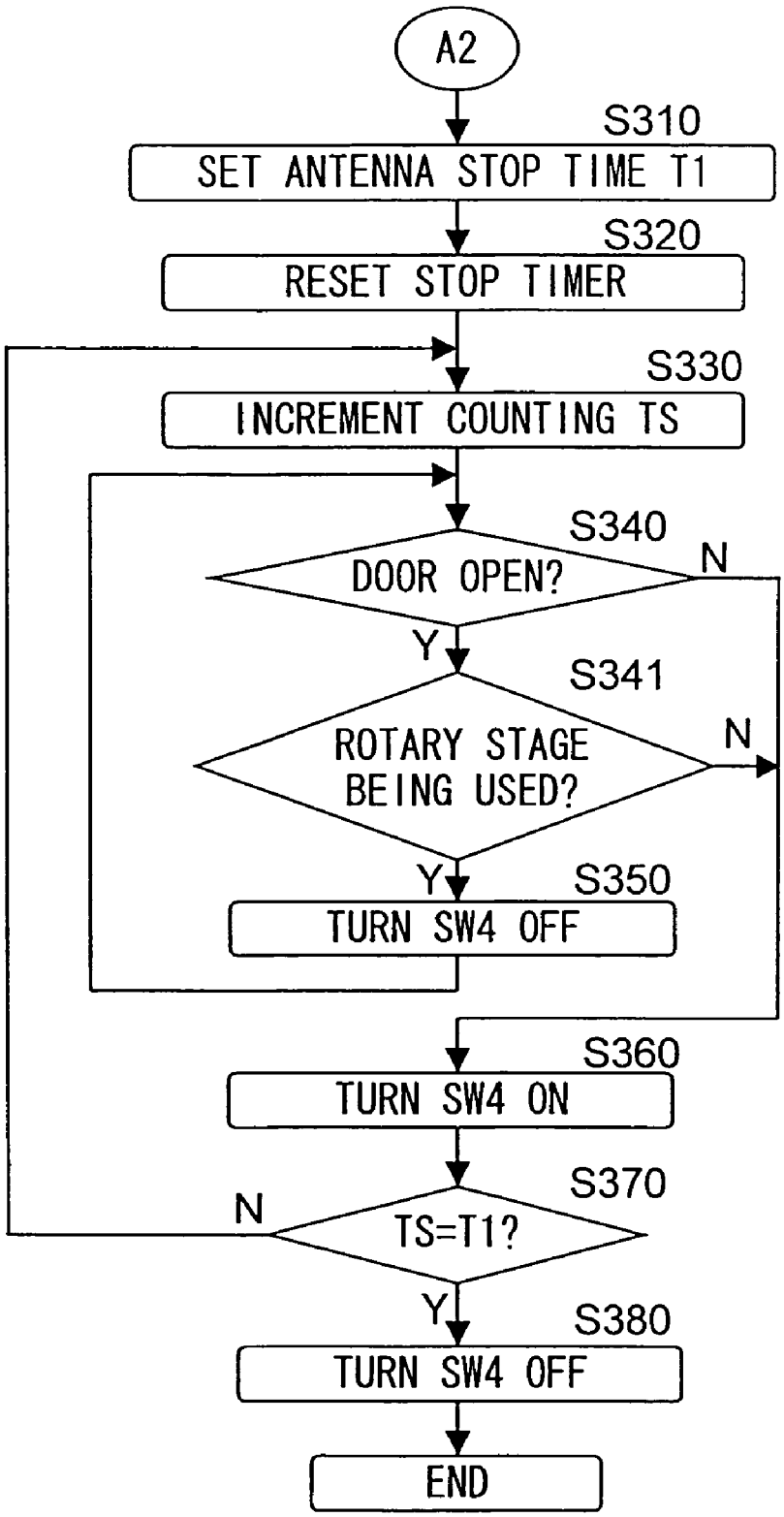
FIG. 30 is a flow chart after heating as used, in a third embodiment, by the control block according to the invention.

Lastly, the third embodiment will be described with reference to FIG. 30. If, in step S105 in FIG. 27 described earlier, the heating means is found not to be high-frequency heating (i.e., if it is found to be heater heating), then the flow proceeds to step S310 in FIG. 30. In this step, the antenna stop time T1 is set. Next, in step S320, the stop timer is reset, and then the flow proceeds to step S330, where the stop timer is started to count time. Next, in step S340, whether or not the door is open is checked. If the door is found to be open, then, in step S341, whether or not the rotary stage 7 is being used is checked. If the rotary stage 7 is found to be used, then, irrespective of whether or not the timer has reached the antenna stop time T1, in step S350, the fourth relay switch SW4 is turned off to stop the rotation of the antenna 4. Then, the flow returns to step S340, where whether or not the door is open is checked again. So long as the door is found to be open and in addition the rotary stage 7 is found to be used, the operations in steps S340, S341, and S350 are repeated. By contrast, if, in step S341, the rotary stage 7 is found not to be used, then the flow proceeds to step S360, where the fourth relay switch SW4 is turned on to rotate the antenna 4. Likewise, if, in step S340, the door is found not to be open, the flow proceeds to step S360, where the fourth relay switch SW4 is turned on to rotate the antenna 4.

Next, in step S370, whether or not the count of the stop timer has reached the predetermined value T1 that was set in step S310 described above is checked. If the count is found to have reached the predetermined value T1, then the flow proceeds to step S380, where the fourth relay switch SW4 is turned off so stop the rotation of the antenna 4, finishing the flow after heating. If the count is found not to have reached that value, the flow returns to step S330 to repeat the operations in steps S330 to S370.

In the above description, the operations after the stopping of heating are described as being performed after the course of heating. It is, however, also possible to perform the operations after the stopping of heating in the same manner after temporary stopping of heating during the course of heating, for example temporary stopping of heating instructed with the press of a key or stopping of heating as a result of the door being opened. The control whereby the antenna is rotated during heater heating may be performed also when high-frequency heating and heater heating are repeated alternately or are performed simultaneously.

As described above, with a high-frequency heating apparatus according to the present invention, in a case where a rotary member is a rotary stage on which to place a heating target, while the advantages of a conventional antenna-type high-frequency heating apparatus are maintained, it is possible to enhance the heating efficiency in grill heating and oven heating, and it is also possible to achieve uniform cooking by sophisticated controls.

On the other hand, in a case where the rotary member is a stirring member placed in a container placed on a stage, while the advantage of an antenna-type microwave oven that the floor of the heating compartment is a flat surface without holes and is thus easy to clean, it is possible to stir foodstuffs put in the container placed in the heating compartment.

INDUSTRIAL APPLICABILITY

High-frequency heating apparatuses according to the present invention find application not only in simple microwave ovens but also in microwave ovens equipped with composite heating functions so as to be capable of grill heating and oven heating.

The invention claimed is:

1. A high-frequency heating apparatus comprising:

a heating compartment in which a heating target is heated;

a high-frequency wave generator that generates a high-frequency wave;

a waveguide through which the high-frequency wave generated by the high-frequency wave generator is guided to an opening formed in the heating compartment;

a freely rotatable antenna that feeds the high-frequency wave inside the waveguide into the heating compartment through the opening and that has a receiver portion and a radiator portion;

a motor that rotates the antenna; and a stage that is provided above and close to the antenna so as to partition an interior of the heating compartment and that is made of a dielectric material, wherein a rotary member is placed on the stage, either magnets are provided on both the rotary member and the antenna, or a magnet is provided on one of the rotary member and the antenna and a magnetic material is provided on the other, and a magnetic coupling between the antenna and the rotary member is exploited to rotate the rotary member as the antenna is rotated.

2. The high-frequency heating apparatus of claim 1, wherein the rotary member is a rotary stage including:

a support member having a plurality of rollers and magnets; and a table that is supported on the support member and on which the heating target is placed.

3. The high-frequency heating apparatus of claim 2, wherein the table is supported on the plurality of rollers by being kept in contact therewith so that, as the rollers rotate, the table rotates.

4. The high-frequency heating apparatus of claim 2, wherein the support member is made of metal, and has at least either an opening or a cut through which to pass the high-frequency wave radiated from the antenna.

5. The high-frequency heating apparatus of claim 1, wherein the rotary member is a stirring member provided in a container placed on the stage.

6. The high-frequency heating apparatus of claim 5, wherein the stirring member includes:

a disk-shaped base;

a stirring wheel that is formed on the base; and two or more rollers pivoted in a peripheral portion of the base.

7. The high-frequency heating apparatus of claim 1, wherein a restricting member is provided on at least one of the antenna and the stage in order to restrict movement of the antenna in an axial direction.

8. The high-frequency heating apparatus of claim 7, wherein the antenna is composed of a cylindrical receiver portion and a substantially disk-shaped radiator portion fitted at a top end of the receiver portion coaxially therewith, and the restricting member is projections formed on a top surface of the radiator portion of the antenna at equal angular intervals in a circumferential direction.

9. The high-frequency heating apparatus of claim 7, wherein the antenna is composed of a cylindrical receiver portion and a substantially disk-shaped radiator portion fitted at a top end of the receiver portion coaxially therewith, and the restricting member is rollers fitted on the radiator portion of the antenna at equal angular intervals in a circumferential direction.

10. The high-frequency heating apparatus of claim 1, wherein a first magnet is provided on the antenna, with a side of the first magnet facing the stage covered with a nonmagnetic member and a side of the first magnet facing a floor of the heating compartment covered with a magnetic member, and a second magnet or a magnetic material is provided on the rotary member in a position corresponding to the first magnet.

11. The high-frequency heating apparatus of claim 10, wherein the antenna is formed of a nonmagnetic member, and the first magnet is provided on a bottom surface of the antenna, with a surface of the first magnet covered with a magnetic member.

12. The high-frequency heating apparatus of claim 10, wherein the antenna is formed of a magnetic member, and the first magnet is provided on a top surface of the antenna, with a surface of the first magnet covered with a nonmagnetic member.

13. The high-frequency heating apparatus of claim 1, further comprising:

a lower heater that is provided close to a periphery of the antenna; and a controller for controlling operation of the motor and the lower heater, wherein, when the lower heater is heated, the antenna is rotated.

14. The high-frequency heating apparatus of claim 13, wherein, when the lower heater stops being heated, the antenna is rotated under a predetermined condition.

15. The high-frequency heating apparatus of claim 14, wherein the predetermined condition is after the lower heater stops being heated until a timer provided for counting a time elapsed thereafter counts a predetermined length of time.

16. The high-frequency heating apparatus of claim 14, wherein the predetermined condition is after the lower heater stops being heated until a temperature sensor for sensing temperature in the heating compartment falls to a predetermined temperature.

17. The high-frequency heating apparatus of one of claim 13, wherein a detector for detecting whether a door of the heating compartment is open or closed is provided so that, when the door is detected to be open after the lower heater stops being heated, rotation of the antenna is stopped.

18. The high-frequency heating apparatus of one of claim 13, wherein, when the rotary member is not used, even if the door is open after the lower heater stops being heated, rotation of the antenna is not stopped.

19. The high-frequency heating apparatus of claim 14, wherein a detector for detecting whether a door of the heating compartment is open or closed is provided so that, when the door is detected to be open after the lower heater stops being heated, rotation of the antenna is stopped.

20. The high-frequency heating apparatus of claim 15, wherein a detector for detecting whether a door of the heating compartment is open or closed is provided so that, when the door is detected to be open after the lower heater stops being heated, rotation of the antenna is stopped.

21. The high-frequency heating apparatus of claim 16, wherein a detector for detecting whether a door of the heating compartment is open or closed is provided so that, when the door is detected to be open after the lower heater stops being heated, rotation of the antenna is stopped.

22. The high-frequency heating apparatus of claim 14, wherein, when the rotatary member is not used, even if the door is open after the lower heater stops being heated, rotation of the antenna is not stopped.

23. The high-frequency heating apparatus of claim 15, wherein, when the rotary member is not used, even if the door is open after the lower heater stops being heated, rotation of the antenna is not stopped.

24. The high-frequency heating apparatus of claim 16, wherein, when the rotary member is not used, even if the door is open after the lower heater stops being heated, rotation of the antenna is not stopped.

25. The high-frequency heating apparatus of claim 17, wherein, when the rotary member is not used, even if the door is open after the lower heater stops being heated, rotation of the antenna is not stopped.

26. The high-frequency heating apparatus of claim 19, wherein, when the rotary member is not used, even if the door is open after the lower heater stops being heated, rotation of the antenna is not stopped.

27. The high-frequency heating apparatus of claim 20, wherein, when the rotary member is not used, even if the door is open after the lower heater stops being heated, rotation of the antenna is not stopped.

28. The high-frequency heating apparatus of claim 21, wherein, when the rotary member is not used, even if the door is open after the lower heater stops being heated, rotation of the antenna is not stopped.

29. The high-frequency heating apparatus of claim 3, wherein the support member is made of metal, and has at least either an opening or a cut through which to pass the high-frequency wave radiated from the antenna.

* * * * *